US005654119A

United States Patent [19]

Ishii et al.

[11] Patent Number: 5,654,119

[45] Date of Patent: Aug. 5, 1997

[54] ORGANIC ELECTRONIC DEVICE COMPRISING CHARGE-TRANSPORTING POLYESTER AND IMAGE FORMING APPARATUS

[75] Inventors: Toru Ishii; Fumio Ojima; Kiyokazu Mashimo; Tomozumi Uesaka; Tomoo Kobayashi; Katsumi Nukada; Akira Imai; Masahiro Iwasaki, all of Minami-ashigara, Japan

[73] Assignee: Fuji Xerox Co., Ltd., Tokyo, Japan

[21] Appl. No.: 628,766

[22] Filed: Apr. 5, 1996

[30] Foreign Application Priority Data

Apr. 6, 1995 [JP] Japan ..... 7-104588
Jul. 11, 1995 [JP] Japan ..... 7-197158

[51] Int. Cl.[6] ..... G03G 5/047

[52] U.S. Cl. ..... 430/59; 430/96

[58] Field of Search ..... 430/58, 59, 83, 430/96

[56] References Cited

U.S. PATENT DOCUMENTS

| | | | |
|---|---|---|---|
| 4,555,171 | 11/1985 | Clouthier et al. | 355/3 CH |
| 4,801,517 | 1/1989 | Frechet et al. . | |
| 4,806,443 | 2/1989 | Yanus et al. . | |
| 4,806,444 | 2/1989 | Yanus et al. . | |
| 4,937,165 | 6/1990 | Ong et al. . | |
| 4,959,288 | 9/1990 | Ong et al. . | |
| 4,983,482 | 1/1991 | Ong et al. . | |
| 5,034,296 | 7/1991 | Ong et al. . | |
| 5,298,617 | 3/1994 | Nukada et al. . | |
| 5,302,479 | 4/1994 | Daimon et al. . | |
| 5,338,636 | 8/1994 | Nukada et al. . | |
| 5,356,743 | 10/1994 | Yanus et al. | 430/59 |
| 5,358,813 | 10/1994 | Iijima et al. . | |
| 5,547,790 | 8/1996 | Umeda et al. | 430/59 |

FOREIGN PATENT DOCUMENTS

| | | |
|---|---|---|
| 59-28903 | 7/1984 | Japan . |
| 61-20953 | 1/1986 | Japan . |
| 63-149669 | 6/1988 | Japan . |
| 1-134456 | 5/1989 | Japan . |
| 1-134457 | 5/1989 | Japan . |
| 1-134462 | 5/1989 | Japan . |
| 4-133065 | 5/1992 | Japan . |
| 4-133066 | 5/1992 | Japan . |
| 4-189873 | 7/1992 | Japan . |
| 5-43813 | 2/1993 | Japan . |
| 5-80550 | 4/1993 | Japan . |
| 5-98181 | 4/1993 | Japan . |
| 5-140472 | 6/1993 | Japan . |
| 5-140473 | 6/1993 | Japan . |
| 5-263007 | 10/1993 | Japan . |
| 5-279591 | 10/1993 | Japan . |

OTHER PUBLICATIONS

37th Joint Seminary of Applied Physics, 31p–K–12 (1990).
The Sixth International Congress on Advances in Non–impact Printing Technologies, Oct. 21–26, 1990; pp. 306–311.
"Daiyonpan Jikken Kagaku Koza" (4th Institute of Experimental Chemistry), vol. 28, index and pp. 208–231 (1992).

*Primary Examiner*—John Goodrow
*Attorney, Agent, or Firm*—Oliff & Berridge

[57] ABSTRACT

An organic electronic device comprises a layer containing a charge-transporting polyester comprising a repeating unit comprising at least one of partial structural units represented by the following formulae (I-a) and (I-b) as a partial structure of repeating unit:

(I-a)

(I-a)

(I-b)

where the symbols in the above formulae are defined in the specification.

16 Claims, 3 Drawing Sheets

ORGANIC ELECTRONIC DEVICE COMPRISING CHARGE-TRANSPORTING POLYESTER AND IMAGE FORMING APPARATUS

FIELD OF THE INVENTION

The present invention relates to an organic electronic device comprising a novel charge-transporting polyester. More particularly, the present invention relates to an electrophotographic photoreceptor comprising a novel charge-transporting polyester and an image forming apparatus comprising a contact-charging apparatus and a photoreceptor comprising a charge-transporting polymer material in combination.

BACKGROUND OF THE INVENTION

A charge-transporting polymer represented by polyvinyl carbazole (PVK) is useful as a photoconductive material for electrophotographic photoreceptor or an organic electric field light-emitting element material as described in transactions of the 37th Joint Seminary of Applied Physics, 31p-K-12 (1990). In both of the above cases, such a charge-transporting polymer is formed into a layer which is used as a charge-transporting layer. A charge-transporting polymer such as PVK and a low molecular weight dispersion system having a low molecular charge-transporting material dispersed in a polymer are well known as the materials for forming the charge transporting layer. An element having a low molecular weight charge-transporting material vacuum-evaporated thereon is generally used as the organic electric field light-emitting element. Among these materials, the low molecular dispersion system is major in the electrophotographic photoreceptor because it has a wide diversity and can easily provide a high functional product. In recent years, organic photoreceptors have been more and more used in high speed copying machines or printers as their performance has been enhanced. However, the ability of these organic photoreceptors may often insufficient even now for use in high speed copying machines or printers. In particular, it has been keenly desired to further prolong the life of these organic photoreceptors. One of the important factors determining the life of these organic photoreceptors is abrasion of the charge-transporting layer. The charge-transporting layer comprising a low molecular weight dispersion system, which is major at present, has been more and more satisfactory with respect to electrical properties. However, such a charge-transporting layer is disadvantageous in that it is essentially apt to mechanical abrasion because of its structure that comprises a low molecular weight compound dispersed in a polymer. Further, the organic electric field light-emitting element is disadvantageous in that the accompanying Joule's heat causes melting of the low molecular weight charge-transporting material, followed by morphological change of the film due to crystallization or the like.

On the other hand, a charge-transporting polymer has a possibility for drastically eliminating these disadvantages and thus is extensively studied. For example, U.S. Pat. No. 4,806,443 discloses a polycarbonate obtained by the polymerization of specific dihydroxyarylamine and bischloroformate. U.S. Pat. No. 4,806,444 discloses a polycarbonate obtained by the polymerization of specific dihydroxyarylamine and phosgene. U.S. Pat. No. 4,801,517 discloses a polycarbonate obtained by the polymerization of bishydroxyalkylarylamine and bischloroformate or phosgene. U.S. Pat. Nos. 4,937,165 and 4,959,288 disclose a polycarbonate obtained by the polymerization of specific dihydroxyarylamine or bishydroxyalkylarylamine and bischloroformate or a polyester obtained by the polymerization of specific dihydroxyarylamine or bishydroxyalkylarylamine and bisacyl halide. Further, U.S. Pat. No. 5,034,296 discloses a polycarbonate or polyester of arylamine having a specific fluorene skeleton. U.S. Pat. No. 4,983,482 discloses a polyurethane. Still further, JP-B-59-28903 (The term "JP-B" as used herein means an "examined Japanese patent publication") discloses a polyester having a specific bis-styrylbisarylamine as a main chain. Further, JP-A-61-20953 (The term "JP-A" as used herein means an "unexamined published Japanese patent application"), JP-A-1-134456, JP-A-1-134457, JP-A-1-134462, JP-A-4-133065, and JP-A-4-133066 propose a polymer having a charge-transporting substituent such as hydrazone and triarylamine as a pendant and a photoreceptor comprising such a polymer.

A charge-transporting polymer is required to exhibit various properties such as solubility, mobility and matching in oxidation potential. In order to satisfy these requirements, it is commonly practiced to introduce various substituents into the charge-transporting polymer to control the physical properties thereof. The ionization potential of a charge-transporting polymer is almost determined by the charge-transporting monomers constituting the charge-transporting polymer. Thus, it is important that the ionization potential of the charge-transporting monomers be controllable. The monomers as starting materials of the above described triarylamine polymer can be roughly divided into two types, i.e., (1) monomers having two hydroxyphenyl groups and (2) monomers having two hydroxyalkylphenyl groups. However, the monomers having two hydroxyphenyl groups easily becomes aminophenol structure and thus can be easily oxidized and can hardly be purified. Further, monomers having a parahydroxy structure is more unstable. It is difficult to control the ionization potential of these monomer by changing the position of substituents. Further, since these monomers have an aromatic ring directly substituted by oxygen, its electron attractive property easily causes biased electric charge distribution, to thereby easily deteriorate its mobility. The monomers having two hydroxyalkylphenyl groups has no adverse effects due to electron attractive property of oxygen because of interposition of a methylene group. However, these monomers can be hardly synthesized. That is, the reaction of diarylamine or diarylbenzidine with 3-bromoiodobenzene tends to provide a mixed product because both bromine and iodine are reactive. Thus, the yield is reduced. Further, an alkyl lithium which is used in lithiumation of bromine, and ethylene oxide is highly hazardous and has a high toxicity, and thus must be carefully handled. Accordingly, an organic electronic device satisfying the desired requirements had never been obtained.

Conventional electrophotographic apparatus such as plain paper copying machine (PPC), laser printer, LED printer and liquid printer operate to apply an imaging process which comprises charging, exposure and development to a photoreceptor such as rotary drum type photoreceptor to form an image, which image is transferred to and then fixed on a transfer material to obtain a duplicated matter. Examples of the photoreceptor used in these image forming apparatus include an inorganic photoreceptor such as selenium, arsenic-selenium, cadmium sulfate, zinc oxide and a-Si or an organic photoreceptor (OPC). Among these photoreceptors, organic photoreceptors are often used because it is inexpensive and has good productivity and disposability. Among these organic photoreceptors, a functionally-separated laminated photoreceptor comprising a laminate of a charge-generating layer and a charge-transporting layer is excellent in electrophotographic properties such as sensitivity, chargeability and repetition stability. Various proposals have been made for such a functionally-separated laminated photoreceptor and put into practical use.

A corona-charging apparatus comprising a fine wire electrode such as gold-plated tungsten wire and a shield plate as main constituents has been widely used as the charging apparatus for charging such a photoreceptor.

However, such a corona-charging apparatus has the following disadvantages:

1) In order to obtain a surface potential of from 500 to 700 V on a latent image retaining member, it is necessary that a high D.C. voltage of not less than 4 kV be applied to the wire electrode. This requires that the distance between the wire electrode and the shield plate be kept great to inhibit the leakage of voltage to the shield plate or the main body. Accordingly, a large-sized apparatus is required. Further, the use of high-tension cable is indispensable. This increases the cost.

2) The corona discharge is accompanied by the production of a relatively large amount of ozone or nitrogen oxides. The resulting nitrogen oxides then react with moisture in the air to produce discharge products such as nitric acid. These discharge products are then attached to or act on the surface of the photoreceptor to modify or deteriorate the photoreceptor, causing image defects such as blurred image. These discharge products are also undesirable from the standpoint of environmental issue, which has recently been getting popular. Accordingly, the use of an exhaust fan, filter or other apparatus for removing these discharge products is indispensable, resulting in a further cost increase.

Instead of using such a troublesome corona charging apparatus, various contact-charging processes have recently been proposed. In these contact-charging processes, an electrically-conductive member to which a voltage has been applied is brought into contact with the surface of a photoreceptor so that electric charge is directly injected into the surface of the photoreceptor to obtain a desired charged potential, as described in JP-A-63-149669 (The term "JP-A" as used herein means an "unexamined published Japanese patent application").

However, application of such a contact-charging process to the conventional functionally-separated organic photoreceptor has the following disadvantages. (1) In general, a charge-transporting layer comprising a polymer binder resin and a low molecular weight charge-transporting material molecularly dispersed therein is used as the outermost layer. This photoreceptor is repeatedly used while the charge-transporting layer is kept in direct contact with the charging member. Thus, the charge-transporting layer remarkably wear out, thereby causing chargeability drop, sensitivity change, etc. Accordingly, the photoreceptor exhibits an extremely reduced life as compared with the case where the corona charging process is employed. (2) Since the charging member is brought into direct contact with the photoreceptor, foreign substances can easily adhere to or can contaminate the surface of the photoreceptor, causing image defects on copied image.

Various causes can be considered for the abrasion of the outermost layer of the photoreceptor and the adhesion of foreign substances to the surface of the photoreceptor. In a charge-transporting layer having a low molecular weight charge-transporting material dispersed in a binder resin, the variation of the contacting manner with the charging member causes local direct passage of current, stressing the photoreceptor not only on the surface thereof but also to the interior thereof. In a process where a d.c. current having an a.c. current superposed thereon is used, the deterioration of the charge-transporting material and the binder resin is accelerated to a greater depth. Further, if the charge-transporting layer has a locally ununiform dispersion of charge-transporting material, the above described deterioration occur ununiformly, too. It is considered that this deteriorates the strength of the outermost layer, thereby rendering the photoreceptor more apt to abrasion. At the same time, the ununiform deterioration causes the formation of nuclei attracting foreign substances.

The present invention has been achieved to solve the above described problems in conventional techniques.

SUMMARY OF THE INVENTION

It is therefore an object of the present invention to provide an organic electronic device comprising a novel charge-transporting polyester which exhibits excellent solubility and film-making properties and can be freely controlled for desired ionization potential and easily synthesized.

Another object of the present invention is to provide an electrophotographic photoreceptor comprising a novel charge-transporting polyester.

A further object of the present invention to provide a contact-charging process image forming apparatus which is less apt to abrasion of photosensitive layer and image defects due to adhesion of foreign substances.

The inventors made extensive studies of a polymer which can be freely controlled for desired physical properties and easily synthesized. As a result, it was found that a novel polyester having a specific structure exhibits excellent charge-transporting properties and mechanical abrasion resistance, and an organic electronic device, particularly an organic photoreceptor, comprising such a novel polyester exhibits a high durability. It was also found that a copolymer obtained by the copolymerization of a plurality of monomers having different physical properties has an increased degree of freedom of control over physical properties, making it possible to design a polymer having better physical properties. It was further found that the use of a branched divalent hydrocarbon group having two or more carbon atoms as T in the following formula (I-a) or (I-b) provides a greater entanglement of polymer chains to allow a further effective protection against abrasion. Thus, the present invention has been worked out.

A first embodiment of the present invention relates to an organic electronic device comprising a layer containing a charge-transporting polyester comprising a repeating unit comprising at least one of partial structural units represented by the following formulae (I-a) and (I-b) as a partial structure of repeating unit:

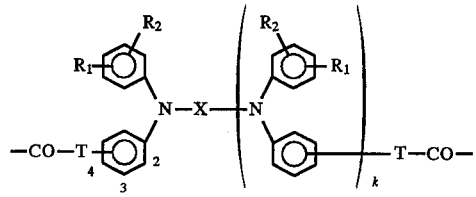

(I-a)

-continued (I-b)

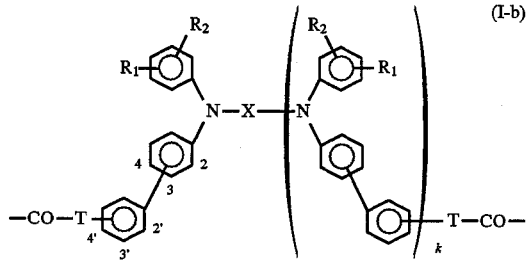

wherein $R_1$ and $R_2$ each independently represent a hydrogen atom, an alkyl group, an alkoxy group, a substituted amino group, a halogen atom or a substituted or unsubstituted aryl group; X represents a substituted or unsubstituted divalent aromatic group; T represents a branched divalent hydrocarbon group having a $C_{2-10}$ aliphatic moiety; and k represents an integer of 0 or 1.

Furthermore, the inventors found that the use of a specific material can render even the contact-charging process less apt to abrasion of photosensitive layer and to image defects due to adhesion of foreign substances.

A second embodiment of the present invention relates to an image forming apparatus comprising a photoreceptor, a charging apparatus, an exposing apparatus and a developing apparatus which operates to form on the photoreceptor an electrostatic image which is then developed to form a visible image, wherein the photoreceptor comprising an electrically-conductive support having thereon a photosensitive layer comprising at least one charge-transporting polyester having a repeating unit comprising at least one of partial structural units represented by the following formulae (I-1) and (I-2), and the charging apparatus is a contact-charging apparatus comprises an electrically-conductive member which comes into contact with the surface of said photoreceptor and to which member a voltage is applied:

(I-1)

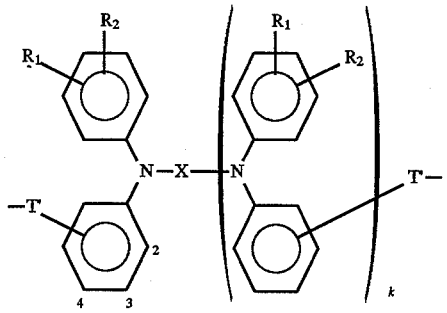

(I-2)

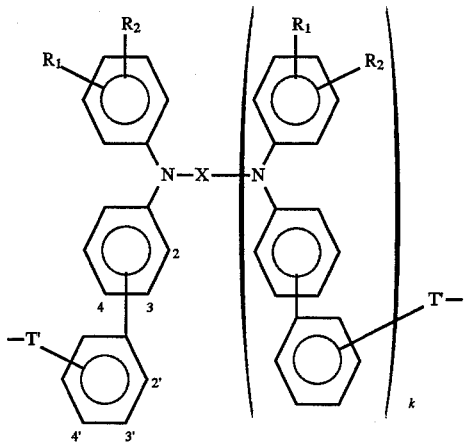

wherein $R_1$ and $R_2$ each independently represent a hydrogen atom, an alkyl group generally having from 1 to 4 carbon atoms, an alkoxy group generally having from 1 to 4 carbon atoms, a substituted amino group, a halogen atom or a substituted or unsubstituted aryl (e.g., phenyl, p-biphenyl and 1-naphthyl) group; X represents a substituted or unsubstituted divalent aromatic group; T' represents a $C_{1-6}$ divalent straight-chain hydrocarbon group or a $C_{2-10}$ divalent branched hydrocarbon group; and k represents an integer of 0 or 1.

Examples of the substituent for the amino group and the aryl group represented by $R_1$ and $R_2$ include $—NH_3$, $—NMe_2$, $—NEt_2$, $—NPh_2$ and an isopropyl group wherein Me represents a methyl group, Et represents an ethyl group and Ph represents a phenyl group.

The above and other objects and features of the present invention will be more apparent from the following description taken in conjunction with the accompanying drawing.

DETAILED DESCRIPTION OF THE INVENTION

Figure 1:
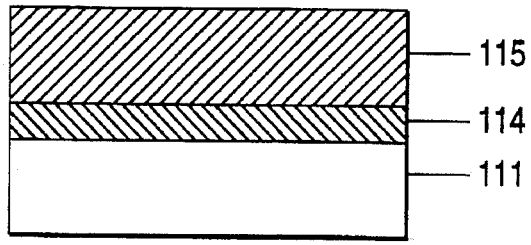
FIGS. 1(*a*) to 1(*f*) are typical sectional views illustrating embodiments of the electrophotographic photoreceptor according to the first embodiment of the present invention.
Figure 1:
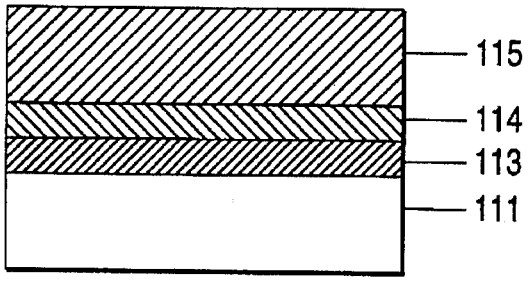
Figure 1:
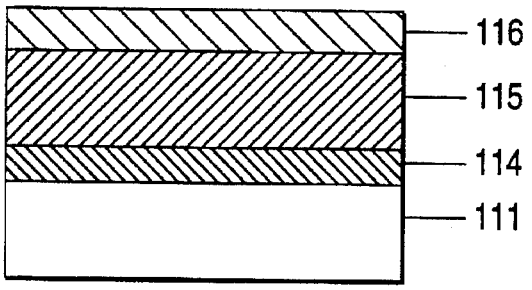
Figure 1:
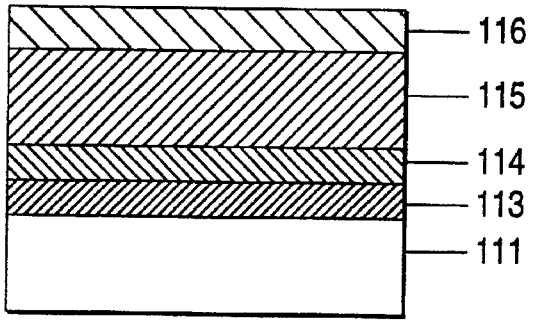
Figure 1:
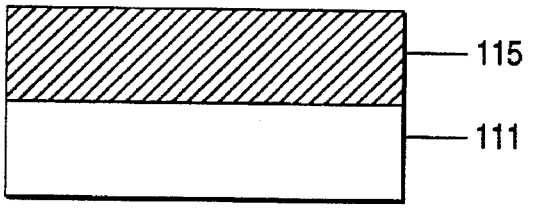
Figure 1:
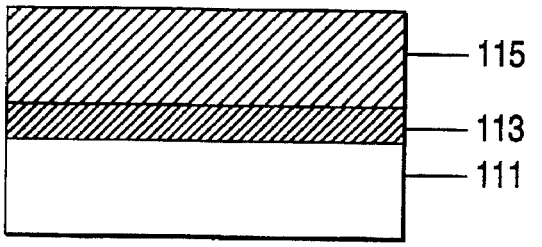

The first embodiment of the present invention is described in detail below.

The charge-transporting polyester for use in the first embodiment of the present invention preferably comprises at least one repeating structural unit selected from the group consisting of structures represented by the following formulae (I-a) and (I-b) as a divalent carboxylic acid component and a repeating structural unit represented by the following formula (III) as a divalent alcohol component, terminated by the following formula (IV-a) or (IV-b) at both ends thereof, and has a polymerization degree of from 5 to 5,000 or at least one repeating structural unit selected from the group consisting of structures represented by the following formulae (I-a) and (I-b) and a repeating structural unit represented by the following formula (II) as a divalent carboxylic acid component and a repeating structural unit represented by the following formula (III) as a divalent alcohol component, terminated by the following formula (IV-a) or (IV-b) at both ends thereof, and exhibits a polymerization degree of from 5 to 5,000:

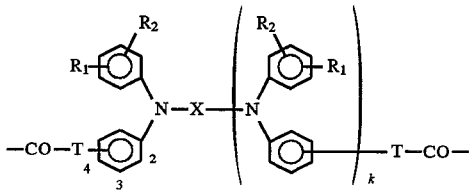

(I-a)

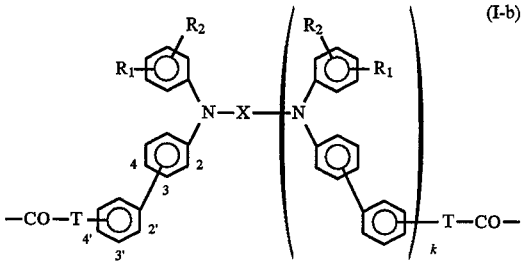

(I-b)

—OC—Z—CO— (II)

—O—(Y—O)$_m$— (III)

—O—(Y—O)$_m$R (IV-a)

—O—(Y—O)$_m$—CO—Z—CO—OR' (IV-b)

wherein $R_1$ and $R_2$ each independently represent a hydrogen atom, an alkyl group generally having from 1 to 4 carbon atoms, an alkoxy group generally having from 1 to 4 carbon atoms, a substituted amino group, a halogen atom or a substituted or unsubstituted aryl (e.g., phenyl, p-biphenyl and 1-naphthyl) group; X represents a substituted or unsubstituted divalent aromatic group; T represents a branched divalent hydrocarbon group having a $C_{2-10}$ aliphatic moiety; Z represents a divalent carboxylic acid residue; R and R' each represent a hydrogen atom, an alkyl group generally having 1 to 4 carbon atoms, a substituted or unsubstituted aryl (e.g., phenyl, p-biphenyl and 1-naphthyl) group or a substituted or unsubstituted aralkyl group generally having from 7 to 10 carbon atoms; Y represents a divalent alcohol residue generally having from 1 to 4 carbon atoms; k represents an integer of 0 or 1; and m represents an integer of from 1 to 5.

Examples of the substituent for the amino group represented by $R_1$ and $R_2$, and the aryl group represented by $R_1$, $R_2$, R and R' include —$NH_3$, —$NMe_2$, —$NEt_2$, —$NPh_2$ and an isopropyl group wherein Me represents a methyl group, Et represents a ethyl group and Ph represents a phenyl group. Further, examples of the substituent for the aralkyl group represented by R and R' include a methyl group, an ethyl group, a t-butyl group and a methoxy group.

T, X, Y and Z in the structural units represented by the above described various formulae is described in detail below.

T represents a branched divalent hydrocarbon group having a $C_{2-10}$ aliphatic moiety. If the number of carbon atoms in the aliphatic moiety is too great, it causes a drop of the glass transition temperature (Tg) of the resulting polymer. Thus, the above defined range is desirable. More preferably, T is selected from the group consisting of branched divalent hydrocarbon groups having a $C_{3-7}$ aliphatic moiety. The branched hydrocarbon group may be further substituted by a substituted or unsubstituted aryl groups. Specific examples of hydrocarbon groups represented by T are given below.

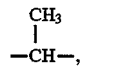

T-1

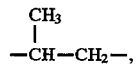

T-2

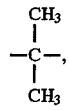

T-3

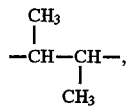

T-4

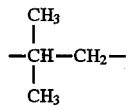

T-5

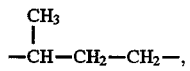

T-6

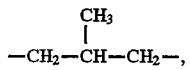

T-7

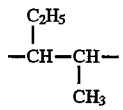

T-8

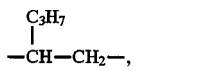

T-9

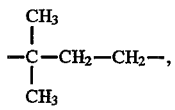

T-10

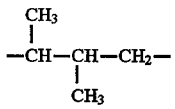

T-11

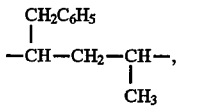

T-12

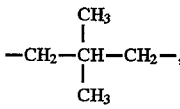

T-13

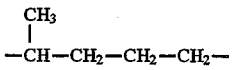

T-14

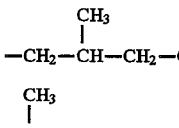

T-15

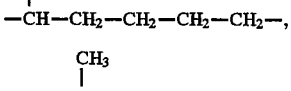

T-16

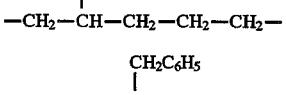

T-17

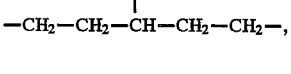

T-18

-continued

T-19 $-CH_2-CH(CH_3)_2-CH_2-CH_2-$,

T-20 $-CH_2-CH(CH_3)-CH_2-CH_2-CH_2-CH_2-$

T-21 $-CH_2-CH(CH_3)-CH_2-CH(CH_3)-CH_2-$,

T-22 $-CH_2-CH(C_2H_5)-CH_2-CH_2-CH_2-CH_2-$,

T-23 $-CH_2-CH(C_2H_5)-CH_2-CH_2-CH_2-CH(CH_3)-$

T-24 $-CH_2-CH(CH_3)-(CH_2)_5-$,

T-25 $-CH_2-CH(C_2H_5)-(CH_2)_4-CH(CH_3)-$,

T-26 $-CH_2-CH(CH_3)-(CH_2)_6-$,

T-27 $-CH_2-CH(C_2H_5)-(CH_2)_5-CH(CH_3)-$

Examples of the group represented by X include those represented by the following formulae (1) to (7):

(1) 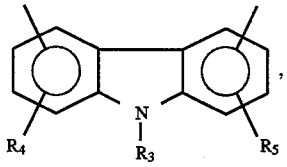

(2) 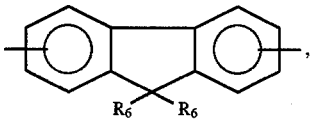

(3) 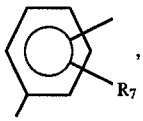

(4) 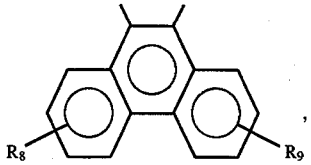

-continued (5) 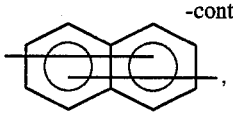

(6) 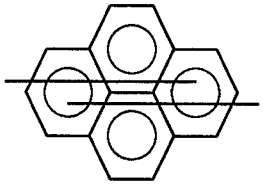

(7) 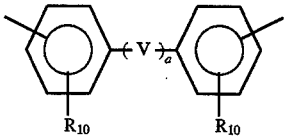

wherein $R_3$ represents a hydrogen atom, a $C_{1-4}$ alkyl group, a substituted or unsubstituted phenyl group or a substituted or unsubstituted aralkyl group generally having from 7 to 10 carbon atoms; $R_4$ to $R_{10}$ each represent a hydrogen atom, a $C_{1-4}$ alkyl group, a $C_{1-4}$ alkoxy group, a substituted or unsubstituted phenyl group, a substituted or unsubstituted aralkyl group generally having from 7 to 10 carbon atoms, or a halogen atom; a represents an integer of 0 or 1. Examples of the phenyl group represented by $R_3$ to $R_{10}$ include a methyl group, an ethyl group and a t-butyl group. Examples of the aralkyl group represented by $R_3$ to $R_{10}$ include a methyl group, an ethyl group, a t-butyl group and a methoxy group. V represents a group selected from the group consisting of those represented by the following formulae (8) to (17):

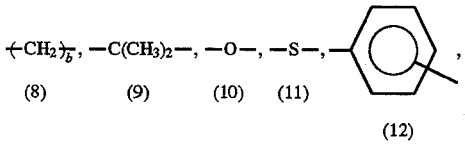

(8) (9) (10) (11) (12)

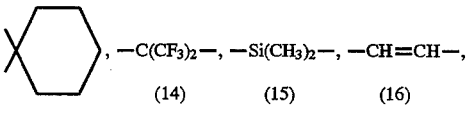

(13) (14) (15) (16)

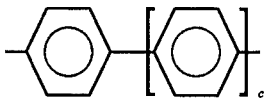

(17)

wherein b represents an integer of from 1 to 10; and c represents an integer of from 1 to 3.

Y and Z each represent a group selected from the group consisting of those represented by the following formulae (18) to (24):

$$-(CH_2)_d-, \quad (18)$$

$$-(CH_2CH_2O)_e-(CH_2CH_2)-, \quad (19)$$

-continued (20)

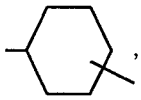

(21)

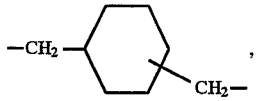

(22)

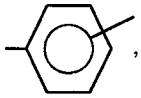

(23)

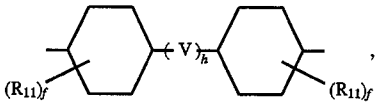

(24)

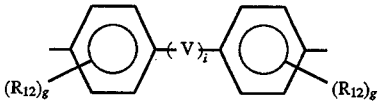

wherein $R_{11}$ and $R_{12}$ each represent a hydrogen atom, a $C_{1-4}$ alkyl group, a $C_{1-4}$ alkoxy group, a substituted or unsubstituted phenyl group, a substituted or unsubstituted aralkyl group generally having from 7 to 10 carbon atoms, or a halogen atom; d and e each represent an integer of from 1 to 10; f and g each represent an integer of from 0 to 2; h and i each represent an integer of 0 or 1; and V is as defined above. Examples of the substituent for the phenyl group represented by $R_{11}$ and $R_{12}$ include a methyl group, an ethyl group and a t-butyl group. Examples of the substituent for the aralkyl group represented by $R_{11}$ and $R_{12}$ include a methyl group, an ethyl group, a t-butyl group and a methoxy group.

The polymerization degree (p) of the above described charge-transporting polymer for use in the first embodiment of the present invention is generally from 5 to 5,000, preferably from 10 to 1,000. The weight-average molecular weight (Mw) of the above described charge-transporting polymer is preferably from 10,000 to 300,000.

Specific examples of the charge-transporting polymer for use in the first embodiment of the present invention are given in Tables 1 to 10 below, but are not limited thereto. Among these compounds, polymers having a biphenyl structure represented by the following structural formula (VII) or (VIII) has a high mobility as described in "The Sixth International Congress on Advances in Non-impact Printing Technologies", 306 (1990), and thus are particularly desirable.

(VII)

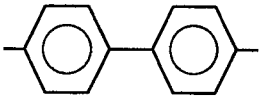

(VIII)

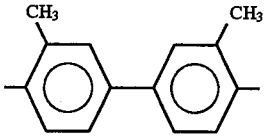

Specific examples of the monomer component having a structure represented by formula (I-a) in the charge-transporting polyester for use in the first embodiment of the present invention are shown in Tables 1 to 5. Specific examples of the monomer component having a structure represented by formula (I-b) are shown in Tables 6 to 10. The column "BP" in tables 1 to 10 indicates the bonding position of T, and the bonding position of phenylene group to which T is bonded. In the column of T, for example, T-2r indicates that an arylamine or tetraarylbenzidine skeleton is bonded to the right side of the structure T-2. T-21 indicates that an arylamine or tetraarylbenzidine skeleton is bonded to the left side of the structure T-2.

TABLE 1

| No. | X | $R_1$ | $R_2$ | BP | k | T |
|---|---|---|---|---|---|---|
| 1 | 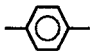 | H | H | 3 | 0 | T-21 |
| 2 | 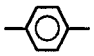 | H | H | 3 | 0 | T-191 |
| 3 | 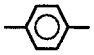 | 3-$CH_3$ | 4-$CH_3$ | 3 | 0 | T-2r |
| 4 | 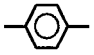 | 3-$CH_3$ | 4-$CH_3$ | 4 | 0 | T-41 |
| 5 | 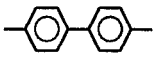 | H | H | 3 | 1 | T-21 |
| 6 | 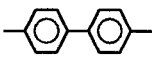 | H | H | 3 | 1 | T-41 |
| 7 | 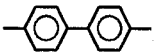 | H | H | 3 | 1 | T-251 |
| 8 | 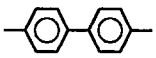 | H | 4-$CH_3$ | 3 | 1 | T-131 |
| 9 | 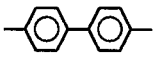 | H | 4-$C_6H_5$ | 3 | 1 | T-41 |
| 10 | 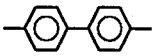 | 3-$CH_3$ | 4-$CH_3$ | 3 | 1 | T-2r |
| 11 | 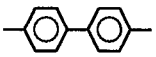 | 3-$CH_3$ | 4-$CH_3$ | 3 | 1 | T-41 |
| 12 | 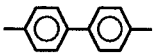 | H | H | 4 | 1 | T-2r |
| 13 | 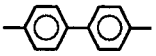 | 3-$CH_3$ | 4-$CH_3$ | 4 | 1 | T-21 |
| 14 | 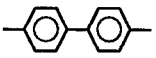 | 4-$CH_3$ | H | 4 | 1 | T-131 |
| 15 | 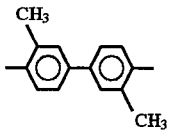 | H | H | 3 | 1 | T-21 |

TABLE 2

| No. | X | $R_1$ | $R_2$ | BP | k | T |
|---|---|---|---|---|---|---|
| 16 | 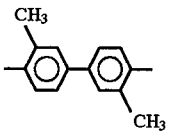 | H | H | 3 | 1 | T-41 |

TABLE 2-continued
| No. | X | $R_1$ | $R_2$ | BP | k | T |
|---|---|---|---|---|---|---|
| 17 | 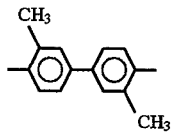 | H | 4-$CH_3$ | 3 | 1 | T-131 |
| 18 | 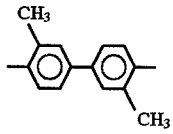 | H | 4-$C_6H_5$ | 3 | 1 | T-41 |
| 19 | 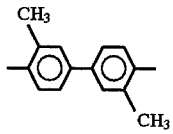 | 3-$CH_3$ | 4-$CH_3$ | 3 | 1 | T-2r |
| 20 | 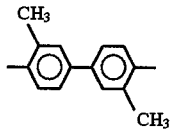 | 3-$CH_3$ | 4-$CH_3$ | 3 | 1 | T-41 |
| 21 | 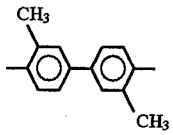 | H | H | 4 | 1 | T-2r |
| 22 | 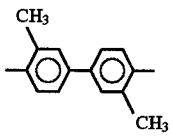 | 3-$CH_3$ | 4-$CH_3$ | 4 | 1 | T-21 |
TABLE 3
| No. | X | $R_1$ | $R_2$ | BP | k | T |
|---|---|---|---|---|---|---|
| 23 | 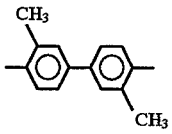 | 4-$CH_3$ | H | 4 | 1 | T-131 |
| 24 | 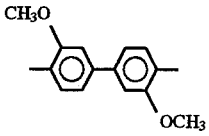 | H | H | 3 | 1 | T-2r |
| 25 | 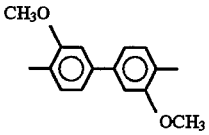 | H | H | 3 | 1 | T-41 |
| 26 | 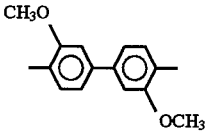 | H | 4-$CH_3$ | 3 | 1 | T-21 |
TABLE 3-continued
| No. | X | $R_1$ | $R_2$ | BP | k | T |
|---|---|---|---|---|---|---|
| 27 | 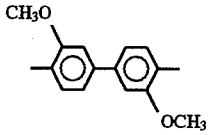 | H | 4-$C_6H_5$ | 3 | 1 | T-221 |
| 28 | 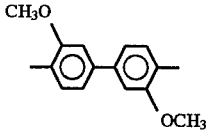 | 3-$CH_3$ | 4-$CH_3$ | 3 | 1 | T-21 |
| 29 | 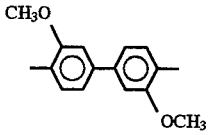 | 3-$CH_3$ | 4-$CH_3$ | 3 | 1 | T-271 |
TABLE 4
| No. | X | $R_1$ | $R_2$ | BP | k | T |
|---|---|---|---|---|---|---|
| 30 | 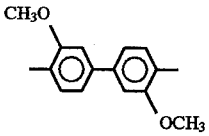 | H | H | 4 | 1 | T-21 |
| 31 | 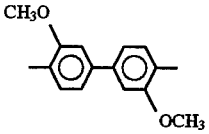 | 3-$CH_3$ | 4-$CH_3$ | 4 | 1 | T-41 |
| 32 | 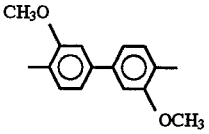 | 4-$CH_3$ | H | 4 | 1 | T-171 |
| 33 | 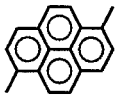 | H | H | 3 | 1 | T-21 |
| 34 | 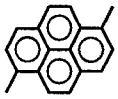 | H | 4-$CH_3$ | 3 | 1 | T-41 |
| 35 | 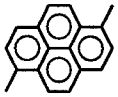 | 3-$CH_3$ | 4-$CH_3$ | 3 | 1 | T-131 |
| 36 | 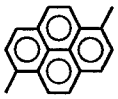 | H | H | 4 | 1 | T-151 |
| 37 | 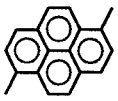 | 4-$CH_3$ | H | 4 | 1 | T-191 |

TABLE 5
| No. | X | $R_1$ | $R_2$ | BP | k | T |
|---|---|---|---|---|---|---|
| 38 | 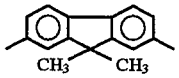 | H | H | 3 | 1 | T-21 |
| 39 | 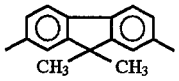 | H | 4-$CH_3$ | 3 | 1 | T-41 |
| 40 | 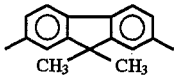 | 3-$CH_3$ | 4-$CH_3$ | 3 | 1 | T-131 |
| 41 | 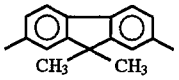 | H | H | 4 | 1 | T-151 |
| 42 | 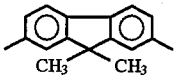 | 4-$CH_3$ | H | 4 | 1 | T-191 |
TABLE 6
| No. | X | $R_1$ | $R_2$ | BP | k | T |
|---|---|---|---|---|---|---|
| 43 | 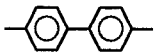 | H | H | 4,4' | 0 | T-21 |
| 44 | 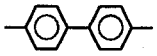 | H | H | 4,4' | 0 | T-191 |
| 45 | 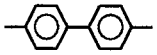 | 3-$CH_3$ | 4-$CH_3$ | 4,4' | 0 | T-2r |
| 46 | 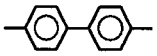 | 3-$CH_3$ | 4-$CH_3$ | 4,4' | 0 | T-41 |
| 47 | 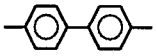 | H | H | 4,4' | 1 | T-21 |
| 48 | 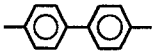 | H | H | 4,4' | 1 | T-41 |
| 49 | 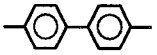 | H | H | 4,4' | 1 | T-251 |
| 50 | 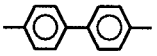 | H | 4-$CH_3$ | 4,4' | 1 | T-131 |
| 51 | 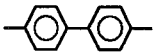 | H | 4-$C_6H_5$ | 4,4' | 1 | T-41 |
| 52 | 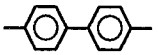 | 3-$CH_3$ | 4-$CH_3$ | 4,4' | 1 | T-2r |
| 53 | 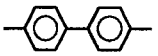 | 3-$CH_3$ | 4-$CH_3$ | 4,4' | 1 | T-41 |
| 54 | 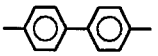 | H | H | 4,4' | 1 | T-2r |
| 55 | 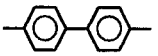 | 3-$CH_3$ | 4-$CH_3$ | 4,4' | 1 | T-21 |
| 56 | 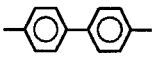 | 4-$CH_3$ | H | 4,4' | 1 | T-131 |
TABLE 7
| No. | X | $R_1$ | $R_2$ | BP | k | T |
|---|---|---|---|---|---|---|
| 57 | 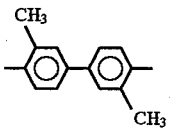 | H | H | 4,4' | 1 | T-21 |
| 58 | 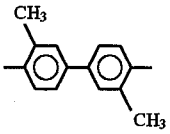 | H | H | 4,4' | 1 | T-41 |
| 59 | 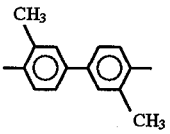 | H | 4-$CH_3$ | 4,4' | 1 | T-131 |
| 60 | 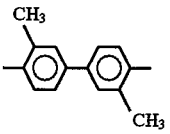 | H | 4-$C_6H_5$ | 4,4' | 1 | T-41 |
| 61 | 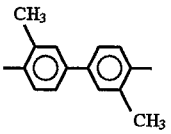 | 3-$CH_3$ | 4-$CH_3$ | 4,4' | 1 | T-2r |
| 62 | 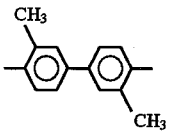 | 3-$CH_3$ | 4-$CH_3$ | 4,4' | 1 | T-41 |
| 63 | 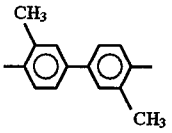 | H | H | 4,4' | 1 | T-2r |
TABLE 8
| No. | X | $R_1$ | $R_2$ | BP | k | T |
|---|---|---|---|---|---|---|
| 64 | 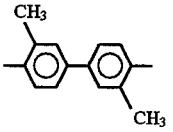 | 3-$CH_3$ | 4-$CH_3$ | 4,4' | 1 | T-21 |
| 65 | 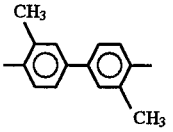 | 4-$CH_3$ | H | 4,4' | 1 | T-131 |
| 66 | 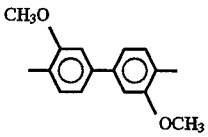 | H | H | 4,4' | 1 | T-2r |

TABLE 8-continued
| No. | X | $R_1$ | $R_2$ | BP | k | T |
|---|---|---|---|---|---|---|
| 67 | 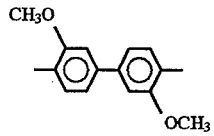 | H | H | 4,4' | 1 | T-41 |
| 68 | 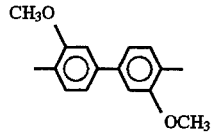 | H | 4-$CH_3$ | 4,4' | 1 | T-21 |
TABLE 8-continued
| No. | X | $R_1$ | $R_2$ | BP | k | T |
|---|---|---|---|---|---|---|
| 69 | 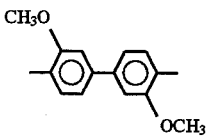 | H | 4-$C_6H_5$ | 4,4' | 1 | T-221 |
| 70 | 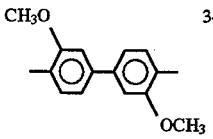 | 3-$CH_3$ | 4-$CH_3$ | 4,4' | 1 | T-21 |
TABLE 9
| No. | X | $R_1$ | $R_2$ | BP | k | T |
|---|---|---|---|---|---|---|
| 71 | 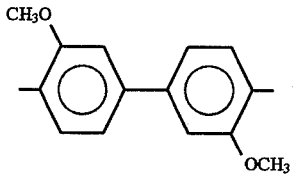 | 3-$CH_3$ | 4-$CH_3$ | 4,4' | 1 | T-271 |
| 72 | 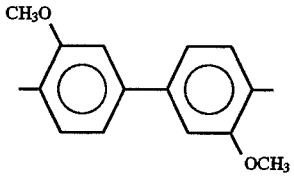 | H | H | 4,4' | 1 | T-21 |
| 73 | 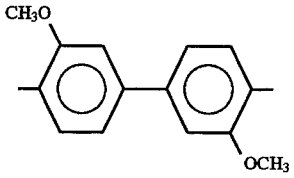 | 3-$CH_3$ | 4-$CH_3$ | 4,4' | 1 | T-41 |
| 74 | 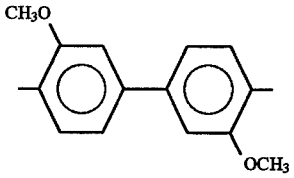 | 4-$CH_3$ | H | 4,4' | 1 | T-171 |
| 75 | 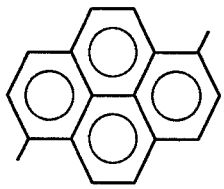 | H | H | 4,4' | 1 | T-21 |

TABLE 9-continued
| No. | X | $R_1$ | $R_2$ | BP | k | T |
|---|---|---|---|---|---|---|
| 76 | 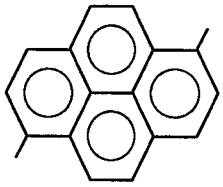 | H | 4-$CH_3$ | 4,4' | 1 | T-41 |
| 77 | 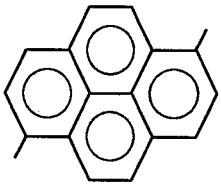 | 3-$CH_3$ | 4-$CH_3$ | 4,4' | 1 | T-131 |
TABLE 10
| No. | X | $R_1$ | $R_2$ | BP | k | T |
|---|---|---|---|---|---|---|
| 78 | 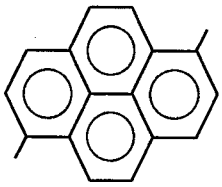 | H | H | 4,4' | 1 | T-151 |
| 79 | 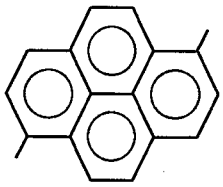 | 4-$CH_3$ | H | 4,4' | 1 | T-191 |
| 80 | 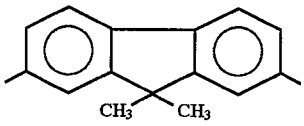 | H | H | 4,4' | 1 | T-21 |
| 81 | 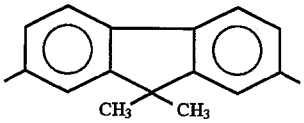 | H | 4-$CH_3$ | 4,4' | 1 | T-41 |
| 82 | 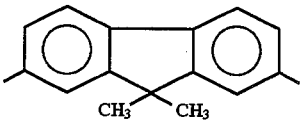 | 3-$CH_3$ | 4-$CH_3$ | 4,4' | 1 | T-131 |
| 83 | 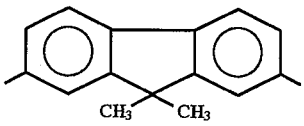 | H | H | 4,4' | 1 | T-151 |

TABLE 10-continued

| No. | X | $R_1$ | $R_2$ | BP | k | T |
|---|---|---|---|---|---|---|
| 84 | 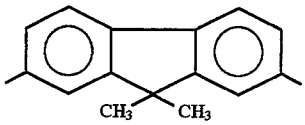 | 4-$CH_3$ | H | 4,4' | 1 | T-191 |

Specific examples of the charge-transporting polyester for use in the first embodiment of the present invention are shown in Tables 11 and 12. In the column of Z, "-" indicates the absence of a repeating structural unit represented by formula (II). If the column of Z is filled, it indicates the presence of a repeating structural unit represented by formula (II). In the column "monomer" in Tables 11 to 12, the sub-column "No." represents the structure No.(s) of the constituting monomer(s), and the sub-column "r" represents the molar ratio of the monomers, when the polyester composed of two or more kinds of monomers.

TABLE 11

| | monomer(s) | | | | | |
|---|---|---|---|---|---|---|
| No. | No. | r | Y | Z | m | p |
| 85 | 22 | — | $-CH_2CH_2-$ | — | 1 | 200 |
| 86 | 22 | — | $-CH_2CH_2-$ | — | 2 | 170 |
| 87 | 22 | — | 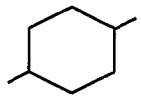 | — | 1 | 150 |
| 88 | 22 | — | 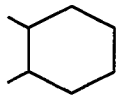 | — | 1 | 160 |
| 89 | 22 | — | 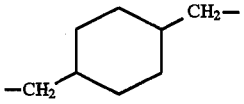 | — | 1 | 140 |
| 90 | 22 | — | $-CH_2CH_2-$ | 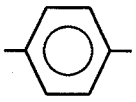 | 1 | 35 |
| 91 | 5 | — | $-CH_2CH_2-$ | — | 1 | 190 |
| 92 | 12 | — | $-CH_2CH_2-$ | — | 1 | 195 |
| 93 | 19 | — | $-CH_2CH_2-$ | — | 1 | 205 |
| 94 | 31 | — | $-CH_2CH_2-$ | — | 2 | 180 |
| 95 | 37 | — | $-CH_2CH_2-$ | — | 1 | 190 |
| 96 | 42 | — | $-CH_2CH_2-$ | — | 1 | 185 |
| 97 | 47 | — | $-CH_2CH_2-$ | — | 1 | 195 |
| 98 | 54 | — | $-CH_2CH_2-$ | — | 1 | 195 |
| 99 | 61 | — | $-CH_2CH_2-$ | — | 1 | 185 |
| 100 | 64 | — | $-CH_2CH_2-$ | — | 1 | 175 |
| 101 | 73 | — | $-CH_2CH_2-$ | — | 1 | 180 |
| 102 | 79 | — | $-CH_2CH_2-$ | — | 1 | 185 |
| 103 | 84 | — | $-CH_2CH_2-$ | — | 1 | 185 |

TABLE 12

| | monomer(s) | | | | | |
|---|---|---|---|---|---|---|
| No. | No. | r | Y | Z | m | p |
| 104 | 5/19 | 1/1 | $-CH_2CH_2-$ | — | 1 | 170 |
| 105 | 5/22 | 1/1 | $-CH_2CH_2-$ | — | 1 | 185 |
| 106 | 12/22 | 1/1 | $-CH_2CH_2-$ | — | 1 | 185 |
| 107 | 5/31 | 1/1 | $-CH_2CH_2-$ | — | 1 | 200 |
| 108 | 5/22 | 1/1 | $-CH_2CH_2-$ | — | 2 | 195 |

TABLE 12-continued

| No. | monomer(s) No. | r | Y | Z | m | p |
|---|---|---|---|---|---|---|
| 109 | 5/22 | 1/1 | 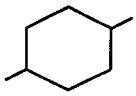 | — | 1 | 160 |
| 110 | 5/22 | 1/1 | 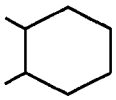 | — | 1 | 150 |
| 111 | 5/22 | 1/1 | 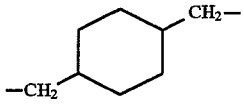 | — | 1 | 130 |
| 112 | 5/22 | 1/1 | $-CH_2CH_2-$ | 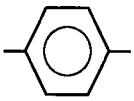 | 1 | 35 |
| 113 | 5/22 | 1/2 | $-CH_2CH_2-$ | — | 1 | 185 |
| 114 | 5/22 | 2/1 | $-CH_2CH_2-$ | — | 1 | 185 |
| 115 | 47/61 | 1/1 | $-CH_2CH_2-$ | — | 1 | 190 |
| 116 | 47/73 | 1/1 | $-CH_2CH_2-$ | — | 1 | 185 |
| 117 | 47/79 | 1/1 | $-CH_2CH_2-$ | — | 1 | 190 |
| 118 | 5/22/47 | 1/1 | $-CH_2CH_2-$ | — | 1 | 190 |

With respect to the synthesis of a charge-transporting material containing an alkylenecarboxylate group, JP-A-5-80550 discloses a process which comprises introducing a chloromethyl group, reacting the chloromethyl group with Mg to produce a Grignard's reagent, converting carbon dioxide into a carboxylic acid, and then esterifying the carboxylic acid in the presence of the Grignard's reagent. However, since the chloromethyl group is highly reactive, it is undesirable to introduce a chloromethyl group into the reactive system at the initial stage of starting material. Accordingly, a synthesis method is required which comprises forming a triarylamine or tetraarylbenzidine skeleton, and then chloromethylating a methyl group which has been introduced into the system at the initial stage of starting material or comprises introducing an unsubstituted methyl group at the initial stage of starting material, forming a tetraarylbenzidine skeleton, allowing the tetraarylbenzidine skeleton to undergo substitution reaction to introduce a functional group such as formyl group into its aromatic ring, reducing the material to an alcohol, and then introducing the alcohol into a chloromethyl group in the presence of a halogenating reagent such as thionyl chloride, or directly chloromethylating the alcohol with a paraform aldehyde, hydrochloric acid, etc.

However, since a charge-transporting material having a triarylamine or tetraarylbenzidine skeleton has a very high reactivity, the method which comprises chloromethylating the methyl group which has been introduced is apt to substitution reaction of halogen for aromatic ring, making it substantially impossible to selectively chlorinating only methyl group. Further, the method which comprises introducing an unsubstituted methyl group at the stage of starting material, introducing a functional group such as formyl group into the material, and then changing the methyl group to a chloromethyl group, and the method which comprises directly chloromethylating the material are disadvantageous in that the chloromethyl group can be introduced into the material only at the para-position to nitrogen atom. Accordingly, an alkylenecarboxylate group can be introduced into the material only at the para-position to nitrogen atom.

On the other hand, the method which comprises the reaction of an arylamine or diarylbenzidine with a halogenated carboalkoxyalkylbenzene to obtain a monomer is advantageous in that the position of substituents can be changed to facilitate the control over ionization potential. This method makes it possible to control the ionization potential of the charge-transporting polymer. The charge-transporting monomer for use in the preparation of the charge-transporting polyester for use in the first embodiment of the present invention can easily have various substituents introduced thereinto at arbitrary positions and stay chemically stable. Thus, the charge-transporting monomer can be easily handled. Accordingly, the above described problems can be solved.

The novel charge-transporting polyester for use in the first embodiment of the present invention can be synthesized from at least one of charge-transporting monomers represented by the following structural formulae (V-a) and (V-b) by a known polymerization process as described, for example, in "Daiyonpan Jikken Kagaku Koza (4th Institute of Experimental Chemistry)", vol. 28 and U.S. Pat. No. 5,034,296.

(V-a)

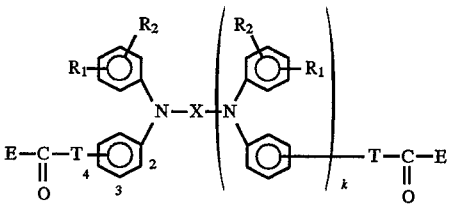

-continued (V-b)

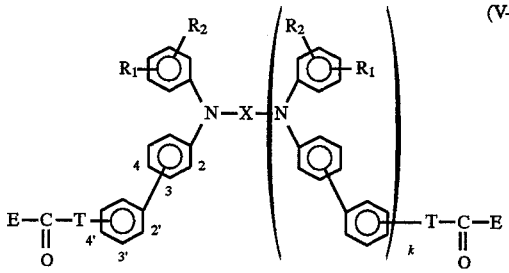

wherein $R_1$, $R_2$, X, T and k each is as defined above, and E represents a hydroxyl group, a halogen atom or —O—$R_{13}$ (in which $R_{13}$ represents an alkyl group generally having from 1 to 4 carbon atoms or an aryl (e.g., phenyl) group which may be substituted by a methyl, ethyl or isopropyl group).

When E is a hydroxyl group, a divalent alcohol represented by HO—(Y—O)$_m$—H is charged in an amount of almost equivalent to the total amount of the charge-transporting monomers. The mixture is then allowed to undergo polymerization in the presence of an acid catalyst. Examples of the acid catalyst for use herein acids employable in ordinary esterification reaction, such as sulfuric acid, toluenesulfonic acid and trifluoroacetic acid. The amount of such an acid catalyst to be used is generally from 1/10,000 to 1/10 parts by weight, preferably from 1/1,000 to 1/50 parts by weight per 1 part by weight of the charge-transporting monomer. In order to remove water produced during the polymerization process, a solvent which is azeotropic with water is preferably used. Examples of such a solvent include toluene, chlorobenzene, 1-chloronaphthalene and the like. Such a solvent may be used in an amount of from 1 to 100 parts by weight, preferably from 2 to 50 parts by weight per 1 part by weight of the charge-transporting monomer. The reaction temperature may be selected appropriately but the reaction is preferably effected at the boiling point of the solvent to remove water produced during the polymerization process. The resulting reaction product, if obtained in the absence of solvent, is then dissolved in a solvent which can dissolve it therein. The reaction product, if obtained in the presence of solvent, is then added dropwise as it is to an alcohol such as methanol and ethanol or a bad solvent for polymer, such as acetone, to cause a charge-transporting polymer to be precipitated. The charge-transporting polymer thus separated is thoroughly washed with water or an organic solvent, and then dried. Further, if necessary, the product is dissolved in an appropriate organic solvent, and then added dropwise to a bad solvent to cause the charge-transporting polymer to be precipitated. This re-precipitation process may be repeated. The re-precipitation process is preferably effected with efficient stirring by means of a mechanical stirrer. The solvent for dissolving the charge-transporting polymer therein in the re-precipitation process may be used in an amount of from 1 to 100 parts by weight, preferably from 2 to 50 parts by weight per 1 part by weight of the charge-transporting polymer. The bad solvent is generally used in an amount of from 1 to 1,000 parts by weight, preferably from 10 to 500 parts by weight per 1 part by weight of the charge-transporting polymer.

When E is a halogen atom, a divalent alcohol represented by HO—(Y—O)$_m$—H is charged in an amount of almost equivalent to the total amount of the charge-transporting monomers. The mixture is then allowed to undergo polymerization in the presence of an organic basic catalyst such as pyridine and triethylamine. The organic basic catalyst is used in an amount of from 1 to 10 equivalents, preferably from 2 to 5 equivalents to the charge-transporting monomer. Examples of the solvent for use herein include methylene chloride, tetrahydrofuran (THF), toluene, chlorobenzene, 1-chloronaphthalene and the like. The solvent may be used in an amount of from 1 to 100 parts by weight, preferably from 2 to 50 parts by weight per 1 part by weight of the charge-transporting monomer. The reaction temperature may be arbitrarily predetermined. After polymerization, the product is subjected to re-precipitation treatment as described above so that it is purified.

If the divalent alcohol is an alcohol having a high acidity such as bisphenol, interfacial polymerization may be employed, too. That is, the divalent alcohol is added to water. The equivalent amount of a base is then dissolved in the aqueous solution. A charge-transporting monomer solution is then added to the aqueous solution in an amount of equivalent to the divalent alcohol with vigorous stirring to effect polymerization. In the polymerization process, water may be used in an amount of from 1 to 1,000 parts by weight, preferably from 2 to 500 parts by weight per 1 part by weight of the divalent alcohol. Examples of the solvent for dissolving the charge-transporting monomer therein include methylene chloride, dichloroethane, trichloroethane, toluene, chlorobenzene, 1-chloronaphthalene and the like. The reaction temperature may be appropriately predetermined. The reaction may be effectively accelerated by the use of a phase transfer catalysis such as ammonium salt and sulfonium salt. The phase transfer catalysis is used in an amount of from 0.1 to 10 parts by weight, preferably from 0.2 to 5 parts by weight per 1 part by weight of the charge-transporting monomer.

When E is —O—$R_{13}$, a divalent alcohol represented by HO—(Y—O)$_m$—H is charged in excess to the total amount of the charge-transporting monomers. The mixture is then heated in the presence of an inorganic acid such as sulfuric acid and phosphoric acid, an acetate or carbonate of titanium alkoxide, calcium or cobalt or an oxide of zinc or lead as a catalyst so that it is allowed to undergo ester interchange to synthesize a charge-transporting polyester. The divalent alcohol may be used in an amount of from 2 to 100 equivalents, preferably from 3 to 50 equivalents to the charge-transporting monomer. The catalyst may be used in an amount of from 1/1,000 to 1 parts by weight, preferably from 1/1,000 to 1/2 parts by weight per 1 part by weight of the charge-transporting monomer. The reaction may be effected at a temperature of from 200° C. to 300° C. After the completion of the conversion of —O—$R_{13}$ to —O—(Y—O)$_m$—H by ester interchange, the reaction is preferably effected under reduced pressure to accelerate the polymerization by the elimination of HO—(Y—O)$_m$—H. Alternatively, the reaction may be effected in a high boiling solvent which is azeotropic with HO—(Y—O)$_m$—H such as 1-chloronaphthalene while HO—(Y—O)$_m$—H is azeotropically distilled off under normal pressure.

Alternatively, in each of the above cases, a divalent alcohol may be added in excess to effect reaction. The resulting compound represented by the following formula (VI-a) or (VI-b) is used as a charge-transporting monomer. The charge-transporting monomer is then reacted with a divalent carboxylic acid or divalent halogen carboxylate to obtain a charge-transporting polyester.

(VI-a)

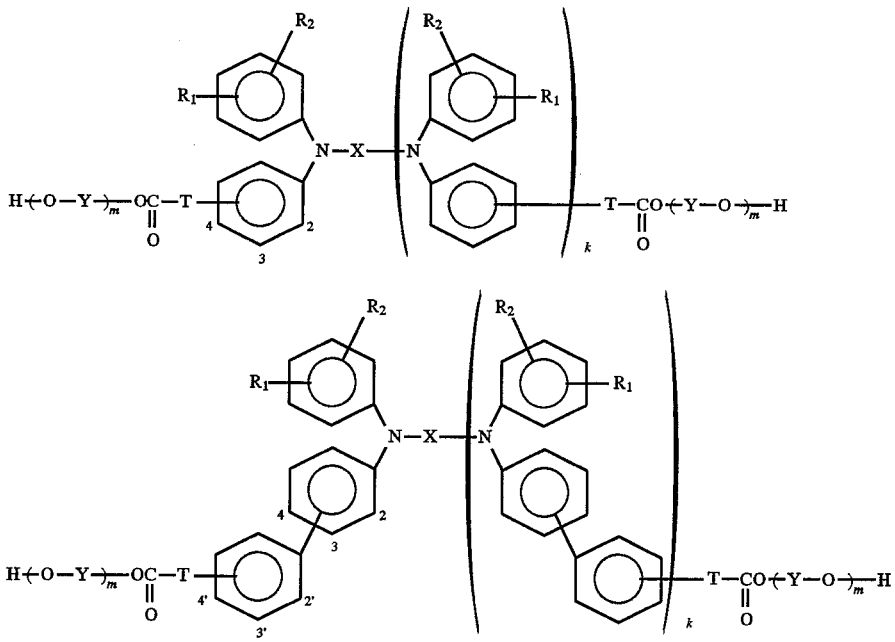

wherein $R_1$, $R_2$, X, Y, T, k and m are as defined above.

If the polymerization degree of the charge-transporting polyester of the present invention is too low, the charge-transporting polyester exhibits poor film-making properties and thus can hardly form a strong film. On the contrary, if the polymerization degree of the charge-transporting polyester of the present invention is too high, it exhibits a low solubility in a solvent and thus can hardly be processed. Accordingly, the polymerization degree of the charge-transporting polyester for use in the present invention is predetermined to generally from 5 to 5,000, preferably from 10 to 3,000, more preferably from 15 to 1,000. The end group of the polymer may be optionally modified.

If the charge-transporting polyester is a copolyester, the proportion of the constituent monomers may be appropriately selected so as to obtain desired physical properties. In order to make up for their disadvantages, these constituent monomers are preferably blended each in about the equal parts. The charge-transporting copolyester may be in any form such as block copolymer, random copolymer, etc. but is preferably in the form of random copolymer from the standpoint of productivity or properties.

The charge-transporting polyester for use in the first embodiment of the present invention may be used in combination with any charge-generating material which has been proposed, such as bisazo pigments, phthalocyanine pigments, squarylium pigments, perylene pigments and dibromoanthanthrone. Furthermore, crystalline halogenated gallium phthalocyanines already disclosed by the present inventors in JP-A-5-98181 (corresponding to U.S. Pat. No. 5,358,813), crystalline halogenated tin phthalocyanines disclosed in JP-A-5-140472 and JP-A-5-140473 (corresponding to U.S. Pat. No. 5,338,636), crystalline hydroxy gallium phthalocyanines disclosed in JP-A-5-263007 (corresponding to U.S. Pat. No. 5,302,479) and JP-A-5-279591, and crystalline titanyl phthalocyanine hydrates disclosed in JP-A-4-189873 (corresponding to U.S. Pat. No. 5,298,617) and JP-A-5-43813 may be used. These combinations of the charge-transporting polyester with the above described phthalocyanine compound provide an electrophotographic photoreceptor having a high sensitivity and an excellent repetition stability. The novel charge-transporting copolymer polyester for use in the first embodiment of the present invention can also be applied to the field of organic electric field light-emitting element, etc.

The crystalline chlorogallium phthalocyanine for use in the present invention can be prepared by subjecting a crystalline chlorogallium phthalocyanine prepared by a known method to mechanical dry grinding by means of an automatic mortar, planetary mill, oscillating mill, CF mill, roll mill, sand mill, kneader or the like, and then optionally subjecting the material to wet grinding with a solvent by means of a ball mill, mortar, sand mill, kneader or the like, as described in JP-A-5-98181. Examples of the solvent for use in the above described treatment include aromatic compounds (e.g., toluene, chlorobenzene), amides (e.g., dimethylformamide, N-methylpyrrolidone), aliphatic alcohols (e.g., methanol, ethanol, butanol), aliphatic polyvalent alcohols (e.g., ethylene glycol, glycerin, polyethylene glycol), aromatic alcohols (e.g., benzyl alcohol, phenethyl alcohol), esters (e.g., acetate, butyl acetate), ketones (e.g., acetone, methyl ethyl ketone), dimethyl sulfoxide, ethers (e.g., diethyl ether, tetrahydrofuran), mixtures of two or more thereof, and mixtures of these organic solvents with water. Such a solvent may be used in an amount of from 1 to 200 times, preferably from 10 to 100 times that of chlorogallium phthalocyanine. The above described treatment is effected at a temperature of from 0° C. to not higher than the boiling point of the solvent, preferably from 10° C. to 60° C. The grinding may be assisted by a grinding aid such as sodium chloride and Glauber's salt. The grinding aid may be used in an amount of from 0.5 to 20 times, preferably from 1 to 10 times the weight of the pigment.

The crystalline dichlorotin phthalocyanine can be obtained by subjecting a crystalline tin phthalocyanine prepared by a known method to grinding and treatment with a solvent in the same manner as the above described chlorogalliumphthalocyanine as disclosed in JP-A-5-140472 and JP-A-5-140473.

The crystalline hydroxygallium phthalocyanine can be prepared by subjecting a crystalline gallium phthalocyanine prepared by a known method to hydrolysis in an acid or alkaline solution or acid pasting to synthesize a crystalline hydroxygallium phthalocyanine which is then subjected to treatment with a solvent immediately or after being subjected to wet grinding with a solvent by means of a ball mill, mortar, sand mill, kneader or the like or after subjected to dry grinding in the absence of solvent, as disclosed in JP-A-5-263007 and JP-A-5-279591. Examples of the solvent for use in the above described treatment include aromatic compounds (e.g., toluene, chlorobenzene), amides (e.g., dimethylformamide, N-methylpyrrolidone), aliphatic alcohols (e.g., methanol, ethanol, butanol), aliphatic polyvalent alcohols (e.g., ethylene glycol, glycerin, polyethylene glycol), aromatic alcohols (e.g., benzyl alcohol, phenethyl alcohol), esters (e.g., ester acetate, butyl acetate), ketones (e.g., acetone, methyl ethyl ketone), dimethyl sulfoxide, ethers (e.g., diethyl ether, tetrahydrofuran), mixtures of two or more thereof, and mixtures of these organic solvents with water. Such a solvent may be used in an amount of from 1 to 200 times, preferably from 10 to 100 times that of hydroxygallium phthalocyanine. The above described treatment is effected at a temperature of from 0° C. to 150° C., preferably from room temperature to 100° C. The grinding may be assisted by a grinding aid such as sodium chloride and Glauber's salt. The grinding aid may be used in an amount of from 0.5 to 20 times, preferably from 1 to 10 times the weight of the pigment.

The crystalline titanyl phthalocyanine can be prepared by subjecting a crystalline titanyl phthalocyanine prepared by a known method to acid pasting or salt milling with an inorganic salt by means of a ball mill, mortar, sand mill, kneader or the like to obtain a crystalline titanyl phthalocyanine having a relatively low crystallinity and exhibiting a peak at $2\theta \pm 0.2° = 27.2°$ in X-ray diffraction spectrum which is then subjected to treatment with a solvent immediately or after being subjected to wet grinding with a solvent by means of a ball mill, mortar, sand mill, kneader or the like, as disclosed in JP-A-4-189873 and JP-A-5-43813. As the acid for use in acid pasting there may be preferably used sulfuric acid having a concentration of from 70 to 100%, preferably from 95 to 100%. The dissolution temperature is predetermined to a range of from −20° C. to 100° C., preferably from 0° C. to 60° C. The amount of concentrated sulfuric acid to be used is predetermined to a range of from 1 to 100 times, preferably from 3 to 50 times the weight of the crystalline titanyl phthalocyanine. As the solvent for precipitating the crystal therein there may be used water or a mixture of water and an organic solvent in an arbitrary amount. Particularly preferred examples of such a mixture include a mixture of water and an alcohol solvent such as methanol and ethanol, and a mixture of water and an aromatic solvent such as benzene and toluene. The temperature at which precipitation is allowed is not specifically limited. In order to prevent the generation of heat, the reaction system is preferably cooled with ice or the like. The weight ratio of crystalline titanyl phthalocyanine to inorganic salt is from 1/0.1 to 1/20, preferably from 1/0.5 to 1/5. Examples of the solvent for use in the above described treatment include aromatic compounds (e.g., toluene, chlorobenzene), amides (e.g., dimethylformamide, N-methylpyrrolidone), aliphatic alcohols (e.g., methanol, ethanol, butanol), halogen hydrocarbons (e.g., dichloromethane, chloroform, trichloroethane), mixtures of two or more thereof, and mixtures of these organic solvents with water. Such a solvent may be used in an amount of from 1 to 100 times, preferably from 5 to 50 times that of titanyl phthalocyanine. The above described treatment is effected at a temperature of from room temperature to 100° C., preferably from 50° C. to 100° C. The grinding aid may be used in an amount of from 0.5 to 20 times, preferably from 1 to 10 times the weight of the pigment.

FIGS. 1(*a*) to 1(*f*) are sectional views illustrating the structure of electrophotographic photoreceptors of the first embodiment of the present invention. The electrophotographic photoreceptor of FIG. 1(*a*) comprises an electrically-conductive support 111 having thereon a charge-generating layer 114 and a charge-transporting layer 115. In the electrophotographic photoreceptor of FIG. 1(*b*), an undercoating layer 113 is provided on the electrically-conductive support 111. The electrophotographic photoreceptor of FIG. 1(*c*) comprises a protective layer 116 provided on the surface thereof. The electrophotographic photoreceptor of FIG. 1(*d*) comprises both an undercoating layer 113 and a protective layer 116. The electrophotographic photoreceptors of FIGS. 1(*e*) and 1(*f*) comprise a photosensitive layer having a single-layer structure. The electrophotographic photoreceptor of FIG. 1(*f*) comprises an undercoating layer 113. The novel charge-transporting polymer according to the first embodiment of the present invention may be used in photoreceptor having any structure shown in FIGS. 1(*a*) to 1(*f*).

Examples of the electrically-conductive support include metals such as aluminum, nickel, chromium and stainless steel, plastic films having thereon a thin film of aluminum, titanium, nickel, chromium, stainless steel, gold, vanadium, tin oxide, indium oxide and ITO, and paper or plastic films coated or impregnated with an electrically conducting agent. Such an electrically-conductive support may be used in an appropriate form such as drum, sheet and plate, but is not limited to these forms. If necessary, the surface of the electrically-conductive support may be subjected to various treatments so long as the image quality cannot be impaired. Examples of these treatments include oxidation, chemical treatment, coloring and treatment for providing irregular reflection such as graining.

Further, an undercoating layer may be provided interposed between the electrically-conductive support and the charge-generating layer. The undercoating layer acts to prevent the injection of electric charge from the electrically-conductive support into the laminated photosensitive layer upon charging of the photosensitive layer. The undercoating layer also acts as an adhesive layer for integrating the photosensitive layer with the electrically-conductive support. In some cases, the undercoating layer acts to prevent the electrically-conductive support from reflecting light.

Examples of the material for use in the undercoating layer include polyethylene resins, polypropylene resins, acryl resins, methacryl resins, polyamide resins, vinyl chloride resins, vinyl acetate resins, phenol resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, aminostarch, polyacrylic acids, polyacrylamides, zirconium chelate compounds, titanyl chelate compounds, titanyl alkoxide compounds, organic titanyl compounds and silane coupling agents. The thickness of the undercoating layer is generally from 0.01 to 10 μm, preferably from 0.05 to 2 μm. Examples of the method for forming the undercoating layer include blade coating method, wire bar coating method, spray coating method, dip coating method, bead coating method, air knife coating method and curtain coating method.

The charge-transporting layer may comprise the above described charge-transporting polyester for use in the first embodiment of the present invention alone or in combination with a known binder resin or other hydrazone charge-transporting materials, triarylamine charge-transporting materials, stilbene charge-transporting materials, etc. The binder resin for use herein is preferably substantially electrically-insulative (having a electrical resistivity of higher than $10^{10}$ Ωcm) and compatible with the charge-transporting polyester.

Examples of the binder resin include known resins such as polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles and polysilanes, but are not limited thereto. Among these binder resins, polycarbonate resins comprising repeating structural units represented by the following structural formulae (IX) to (XIV) or polycarbonate resins obtained by the copolymerization of these polycarbonate resins exhibit a good compatibility with the charge-transporting polymer and thus can provide a homogeneous film that shows good properties. The weight mixing ratio of the charge-transporting polymer to the binder resin is preferably from 10:0 to 8:10. If the charge-transporting polymer is mixed with other charge-transporting materials, the ratio of the total amount of the charge-transporting polymer and the binder resin to charge-transporting material is preferably from 10:0 to 10:8. The thickness of the charge-transporting layer is generally from 10 to 50 μm, preferably from 15 to 35 μm.

(IX)

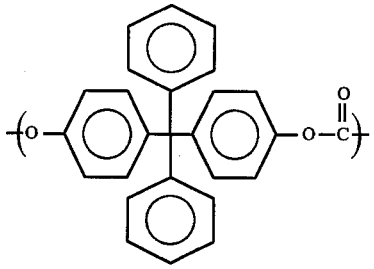

(X)

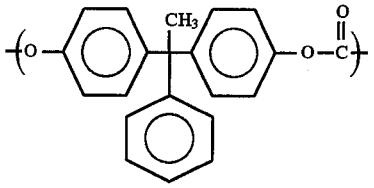

(XI)

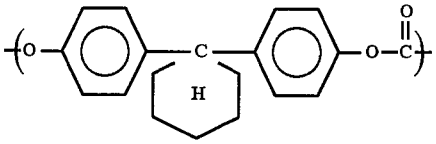

(XII)

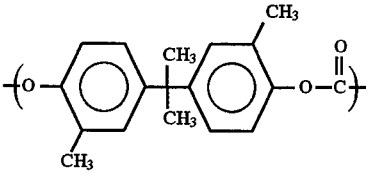

-continued (XIII)

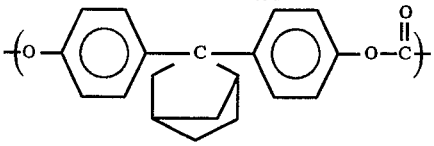

(XIV)

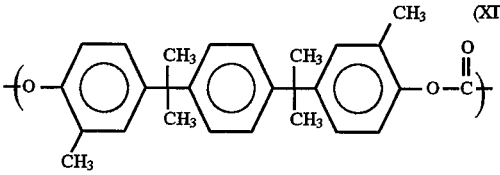

The charge-generating layer comprises a charge-generating material, and optionally may further comprise a binder resin. Examples of the charge-generating material include any known charge-generating materials such as bisazo pigments, phthalocyanine pigments, squarylium pigments, perylene pigments and dibromoanthanthrone pigments. Of these, the above described crystalline halogenated gallium phthalocyanine, crystalline halogenated tin phthalocyanine, crystalline hydroxygallium phthalocyanine and crystalline titanyl phthalocyanine hydrate are preferred.

The binder resin for use in the charge-generating layer may be selected from a wide variety of insulating resins. It may also be selected from the group consisting of organic photoconductive polymers such as poly-N-vinylcarbazole, polyvinyl anthracene, polyvinylpyrene and polysilane. Preferred examples of the binder resin include insulating resins such as polyvinyl butyral resins, polyarylate resins (e.g., polycondensate of bisphenol A with phthalic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins and polyvinyl pyrrolidone resins, but are not limited thereto. These binder resins may be used alone or in combination of two or more thereof.

The weight ratio of the charge-generating material to the binder resin is preferably from 10:1 to 1:10. Examples of the method for dispersing the charge-generating material in the binder resin include ball mill dispersion method, attritor dispersion method and sand mill dispersion method.

The effective grain size attained by this dispersion method is not more than 0.5 μm, preferably not more than 0.3 μm, more preferably not more than 0.15 μm. Examples of the solvent for use in the dispersion method include ordinary organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene, and mixtures of two or more thereof. The thickness of the charge-generating layer is generally from 0.01 to 5 μm, preferably from 0.05 to 2 μm.

The protective layer for use in the photoreceptor may comprise the charge-transporting polyester for use in the first embodiment of the present invention alone. Alternatively, the protective layer may comprise the charge transporting polyester, other charge-transporting material(s) and a binder resin in, admixture. Examples of the binder resin for the protective layer include those exemplified as the binder resin for the charge-transporting layer. The thickness of the protective layer is generally from 0.5 to 1.0 μm, preferably from 1 to 5 μm.

The second embodiment of the present invention is described in detail below.

Figure 2:
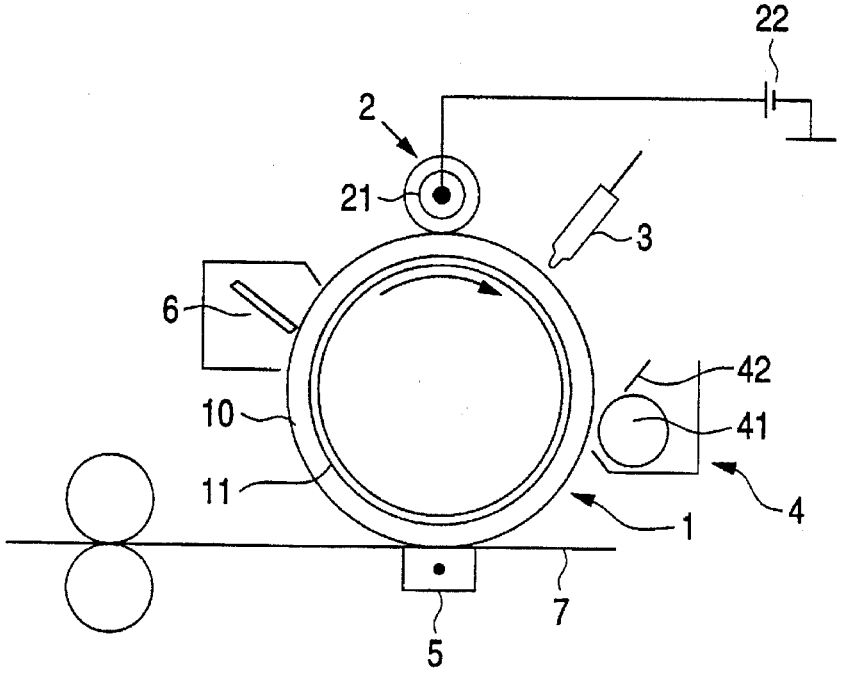
FIG. 2 is a schematic diagram of an image forming apparatus according to the second embodiment of the present invention.

FIG. 2 is a schematic view illustrating the structure of the image forming apparatus according to the second embodiment of the present invention. The image forming apparatus comprises a charging apparatus 2, an exposing apparatus 3, a developing apparatus 4, a transferring apparatus 5 and a cleaning apparatus 6 provided around a photoreceptor 1 comprising an electrically-conductive support 11 having thereon a photosensitive layer 10. In FIG. 2, the charging apparatus 2 comprises a roll charger which is brought into contact with the surface of the photoreceptor. The charging apparatus 2 comprises an electrically-conductive member 21 and is arranged such that a voltage from a power supply 22 is applied to an electrically-conductive member 21. Reference numerals 7, 41 and 42 represent a transfer paper, a developing roll and a layer regulating member, respectively.

Figure 3:
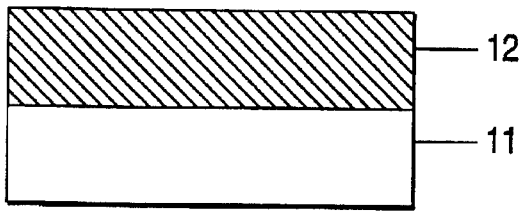
FIG. 3 is a typical sectional view of an embodiment of the photoreceptor according to the second embodiment of the present invention.
Figure 4:
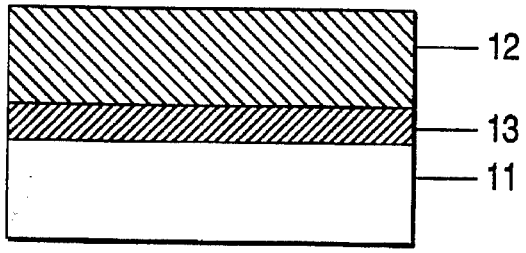
FIG. 4 is a typical sectional view of another embodiment of the photoreceptor according to the second embodiment of the present invention.

In the photoreceptor for use in the image forming apparatus according to the second embodiment of the present invention, the photosensitive layer may have either of a single-layer structure and a functionally-separated laminated structure. FIGS. 3 to 7 are typical sectional views of photoreceptors according to the second embodiment of the present invention. FIGS. 3 and 4 illustrate photoreceptors having a single-layer photosensitive layer. These photoreceptors each comprise an electrically-conductive support 11 having thereon a photoconductive layer 12. The photoreceptor of FIG. 3 further comprises an undercoating layer 13 interposed between the electrically-conductive support 11 and the photoconductive layer 12.

Figure 5:
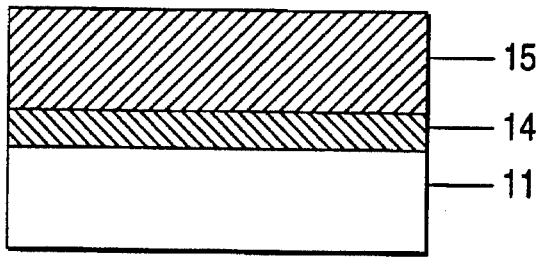
FIG. 5 is a typical sectional view of still another embodiment of the photoreceptor according to the second embodiment of the present invention.
Figure 6:
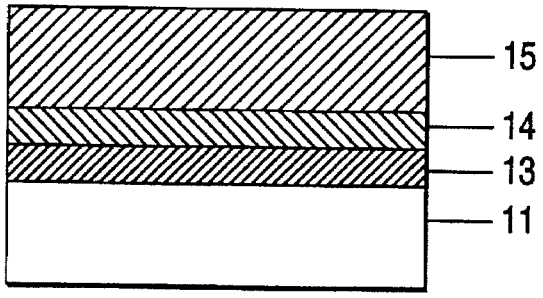
FIG. 6 is a typical sectional view of a further embodiment of the photoreceptor according to the second embodiment of the present invention.
Figure 7:
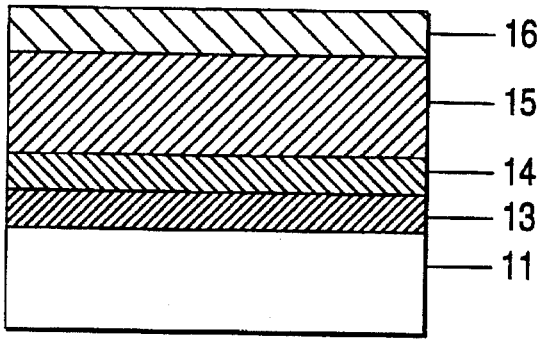
FIG. 7 is a typical sectional view of a still further embodiment of the photoreceptor according to the second embodiment of the present invention.

FIGS. 5 to 7 illustrate photoreceptors having a laminated photosensitive layer. The photoreceptor of FIG. 5 comprises a charge-generating layer 14 and a charge-transporting layer 15 sequentially provided on an electrically-conductive support 11. The photoreceptor of FIG. 6 further comprises an undercoating layer 13 interposed between the electrically-conductive support 11 and the charge-generating layer 14. The photoreceptor of FIG. 7 further comprises a protective layer 16 provided on the charge-transporting layer 15.

In the second embodiment of the present invention, the above described photosensitive layer comprises a charge-transporting polyester having a repeating structural unit comprising at least one of partial structural units represented by formulae (I-1) and (I-2). If the photosensitive layer comprises a plurality of layers, the layer comprising the above described charge-transporting polyester may be provided as the outermost layer (protective layer) of the photosensitive layer.

Further, the photosensitive layer preferably comprises both the above described charge-transporting polyester and a polycarbonate resin having at least one repeating structural unit selected from the group consisting of those represented by the following formulae (A) to (E):

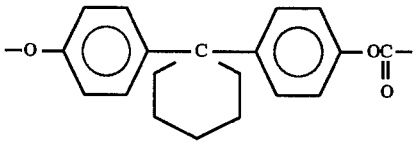

(A)

-continued

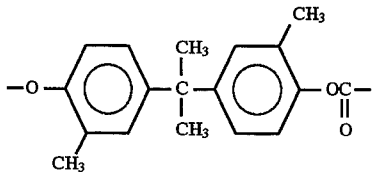

(B)

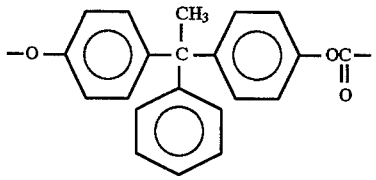

(C)

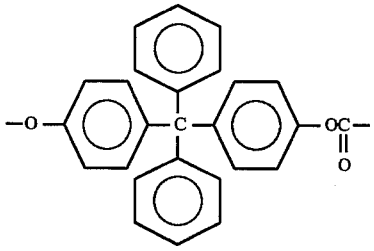

(D)

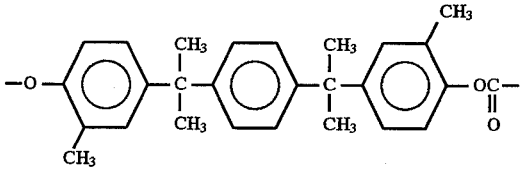

(E)

The photosensitive layer for use in the second embodiment of the present invention may comprise at least one other layer comprising other compound groups interposed between the above described layer containing a charge-transporting polyester and the electrically-conductive substrate. At least one of these layers may generate charge when irradiated with light.

Further, the photoreceptor for use in the second embodiment of the present invention may comprise a layer for transporting a charge besides the charge-generating layer and the outermost layer containing the above described charge-transporting polyester.

The charge-transporting polyester having a repeating structural unit comprising at least one of partial structural units represented by formulae (I-1) and (I-2) is described in detail below.

Polyesters represented by the following formula (II) or (III) are preferably used as the charge-transporting polyester for use in the second embodiment of the present invention:

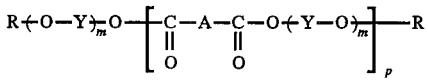

(II)

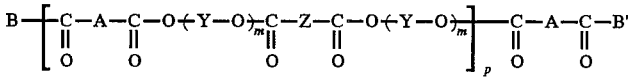

(III)

wherein A represents a structure represented by the above described formula (I-1) or (I-2); R represents a hydrogen atom, an alkyl group generally having from 1 to 4 carbon atoms, a substituted or unsubstituted aryl (e.g., phenyl, p-biphenyl and 1-naphthyl) group or a substituted or unsubstituted aralkyl group generally having from 7 to 10 carbon atoms; B and B' each represent —O—(Y—O)$_m$—R or —O—(Y—O)$_m$—CO—Z—CO—O—R' (wherein R is as defined above, R' represents a hydrogen atom, an alkyl group generally having from 1 to 4 carbon atoms, a substituted or unsubstituted aryl (e.g., phenyl, p-biphenyl and 1-naphthyl) group or a substituted or unsubstituted aralkyl group generally having from 7 to 10 carbon atoms; and m represents an integer of from 1 to 5); Y represents a divalent alcohol residue generally having from 1 to 4 carbon atoms; Z represents a divalent carboxylic acid residue; m represents an integer of 1 from to 5; and p represents an integer of from 5 to 5,000. Examples of the substituent for the aryl group represented by A and R' include a methyl group, an ethyl group, a t-butyl group and an isopropyl group. Examples of the substituent for the aralkyl group represented by R and R' include a methyl group, an ethyl group, a t-butyl group and a methoxy group.

X, Y and Z in the above described formula (I-1) or (I-2) are described in detail below.

Examples of X include the following groups:

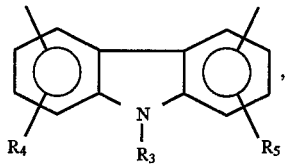

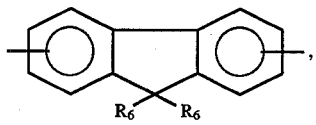

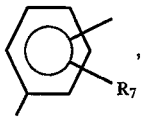

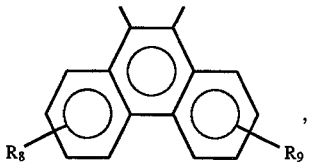

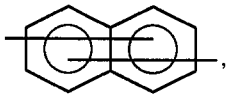

-continued

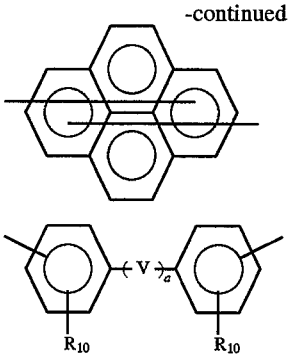

wherein $R_3$ represents a hydrogen atom, a $C_{1-4}$ alkyl group, a substituted or unsubstituted phenyl group or a substituted or unsubstituted aralkyl group generally having from 7 to 10 carbon atoms; $R_4$ to $R_{10}$ each represent a $C_{1-4}$ alkyl group, a $C_{1-4}$ alkoxy group, a substituted or unsubstituted phenyl group, a substituted or unsubstituted aralkyl group generally having from 7 to 10 carbon atoms, or a halogen atom; and a represents an integer of 0 or 1. Examples of the substituent for the phenyl group represented by $R_3$ and $R_4$ to $R_{10}$ include a methyl group, an ethyl group and a t-butyl group. Examples of the substituent for the aralkyl group represented by $R_3$ and $R_4$ to $R_{10}$ include a methyl group, an ethyl group, a t-butyl group and a methoxy group. V is selected from the following groups:

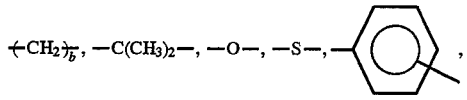

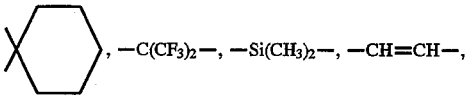

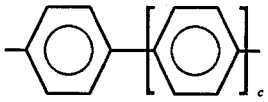

wherein b represents an integer of from 1 to 10; and c represents an integer of from 1 to 3.

Among these groups, those having the following structures have a high carrier mobility and are particularly preferred as described in "The Sixth International Congress on Advances in Non-impact Printing Technologies", 306 (1990):

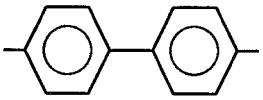

-continued

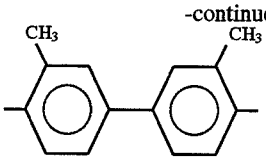

Examples of each of Y and Z include the following groups:

$-(CH_2)_d-$, $-(CH_2CH_2O)_e-(CH_2CH_2)-$,

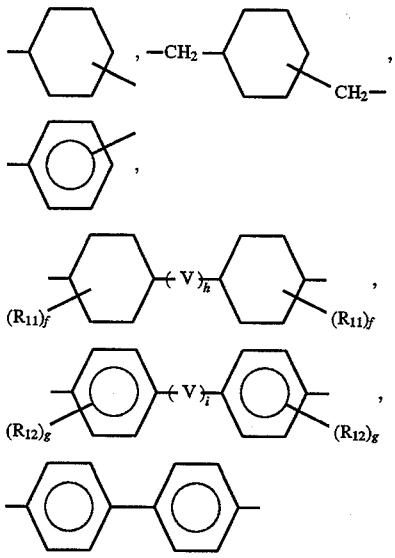

wherein $R_{11}$ and $R_{12}$ each represent a hydrogen atom, a $C_{1-4}$ alkyl group, a $C_{1-4}$ alkoxy group, a substituted or unsubstituted phenyl group, a substituted or unsubstituted aralkyl group generally having from 7 to 10 carbon atoms or a halogen atom; d and e each represent an integer of from 1 to 10; f and g each represent an integer of from 0 to 2; h and i each represent an integer of 0 or 1; and V is as defined above. Examples of the substituent for the phenyl group represented by $R_{11}$ and $R_{12}$ include a methyl group, an ethyl group and a t-butyl group. Examples of the substituent for the aryl group represented by $R_{11}$ and $R_{12}$ include a methyl group, an ethyl group, a t-butyl group and a methoxy group.

The polymerization degree p of the above described charge-transporting polymer for use in the present invention is generally from 5 to 5,000, preferably from 10 to 1,000. The weight-average molecular weight (Mw) of the charge-transporting polymer is preferably from 10,000 to 300,000 in styrene equivalence as determined by GPC.

T' in the above described formulae (I-1) and (I-2) represents a $C_{1-6}$ divalent straight-chain hydrocarbon group or a $C_{2-10}$ branched hydrocarbon group, preferably a $C_{3-7}$ branched hydrocarbon group. Specific examples of the structure of the group T' are given below.

$-CH=CH-$, $-CH=CH-CH=CH-$, $-CH_2-CH=CH-CH_2-$, $-CH_2-$, $-(CH_2)_2-$, $-(CH_2)_3-$, $-(CH_2)_4-$, $-(CH_2)_5-$, $-(CH_2)_6-$,

-continued

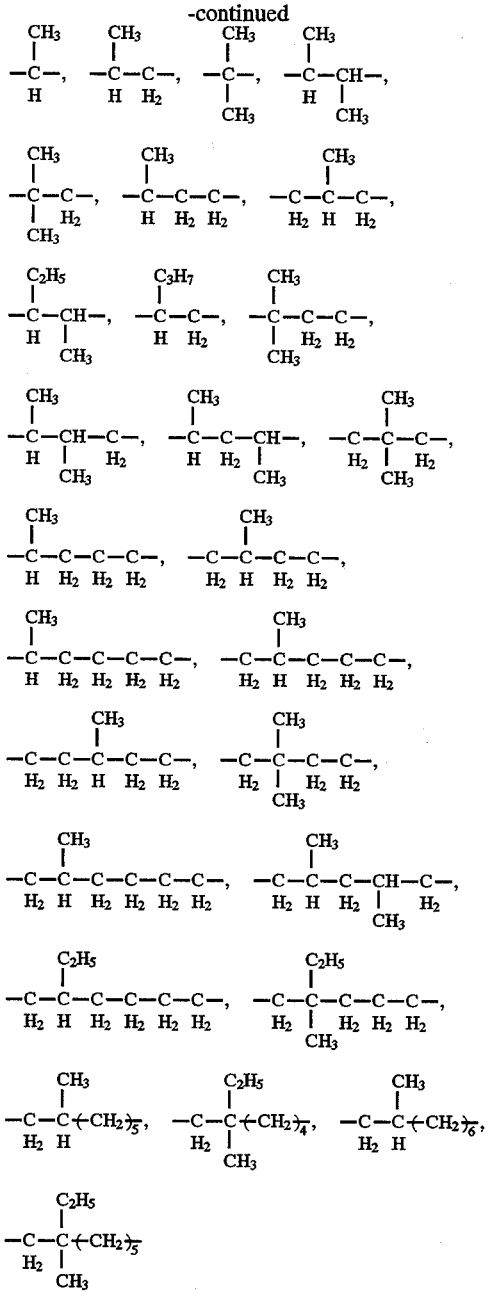

Specific examples of the above described charge-transporting polyester are shown below. Specific examples of the structure represented by formula (I-1) are shown in Tables 13 to 16 below. Specific examples of the structure represented by formula (I-2) are shown in Tables 17 to 20 below. Specific examples of the charge-transporting polyesters represented by formulae (II) and (III) are shown in Tables 21 to 26 below. In Tables 21 to 26, when the column of Z only shows "-", the polyester comprises a charge-transporting polyester represented by formula (II). When the column of Z shows a structural formula, the polyester comprises a charge-transporting polyester represented by formula (III). The column "BP" in tables 1 to 10 indicates the bonding position of T, and the bonding position of the phenylene group to which T is bonded. In the column "monomer" in Tables 21 to 26, the sub-column "No." represents the structure No.(s) of the constituting monomer (s), and the sub-column "r" represents the molar ratio of the monomer(s) used, when the polyester composed of two or more kinds of monomers. R and R' each represents a hydrogen atom in these specific examples.
TABLE 13
| No. | k | X | $R_1$ | $R_2$ | BP | T |
|---|---|---|---|---|---|---|
| 1' | 0 | 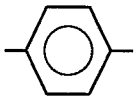 | 3-$CH_3$ | 4-$CH_3$ | 3 | $-CH_2CH_2-$ |
| 2' | 0 | 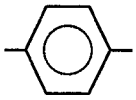 | H | H | 4 | $-CH_2CH_2-$ |
| 3' | 1 | 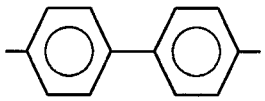 | H | H | 2 | $-CH_2CH_2-$ |
| 4' | 1 | 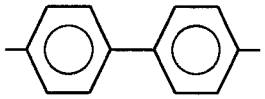 | H | H | 3 | $-CH_2CH_2-$ |
| 5' | 1 | 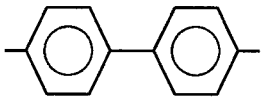 | H | H | 4 | $-CH_2CH_2-$ |
| 6' | 1 | 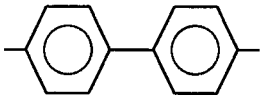 | H | H | 4 | $-CH_2-$ |
| 7' | 1 | 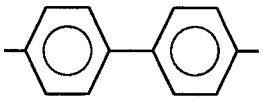 | H | H | 3 | $-CH_2CH_2CH_2CH_2-$ |
| 8' | 1 | 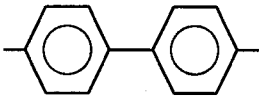 | 4-$CH_3$ | H | 3 | $-CH_2CH_2-$ |
| 9' | 1 | 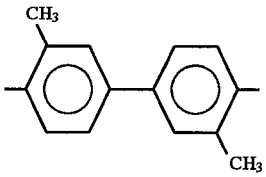  | H | H | 3 | $-CH_2CH_2-$ |
| 10' | 1 | 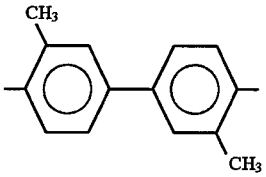  | 2-$CH_3$ | H | 3 | $-CH_2CH_2-$ |
| 11' | 1 | 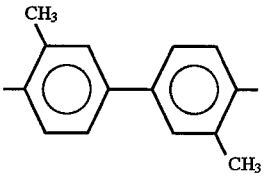  | 3-$CH_3$ | H | 3 | $-CH_2CH_2-$ |

TABLE 14
| No. | k | X | $R_1$ | $R_2$ | BP | T |
|---|---|---|---|---|---|---|
| 12' | 1 | 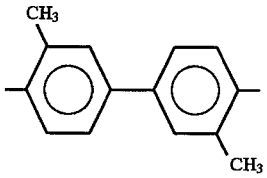 | 4-$CH_3$ | H | 3 | $-CH_2CH_2-$ |
| 13' | 1 | 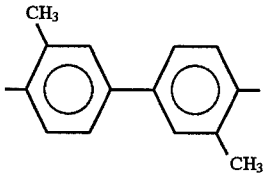 | 3-$CH_3$ | 4-$CH_3$ | 3 | $-CH_2CH_2-$ |
| 14' | 1 | 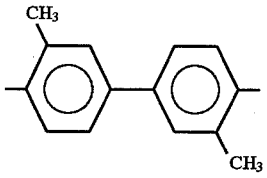 | 3-$CH_3$ | 5-$CH_3$ | 3 | $-CH_2CH_2-$ |
| 15' | 1 | 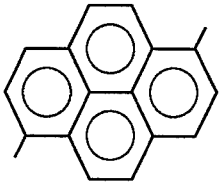 | H | H | 3 | $-CH_2CH_2-$ |
| 16' | 0 | 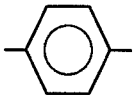 | 3-$CH_3$ | 4-$CH_3$ | 4 | $-CH_2C(CH_3)_2CH_2-$ |
| 17' | 0 | 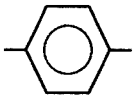 | H | H | 4 | $-CH_2C(CH_3)_2CH_2-$ |
| 18' | 1 | 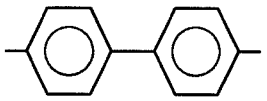 | H | H | 3 | $-CH_2C(CH_3)_2CH_2-$ |
TABLE 15
| No. | k | X | $R_1$ | $R_2$ | BP | T |
|---|---|---|---|---|---|---|
| 19' | 1 | 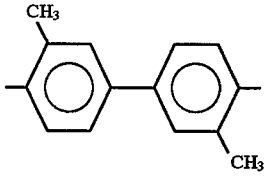 | H | H | 3 | $-CH_2C(CH_3)_2CH_2-$ |

TABLE 15-continued
| No. | k | X | $R_1$ | $R_2$ | BP | T' |
|---|---|---|---|---|---|---|
| 20' | 1 | 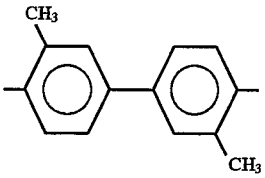 | 3-$CH_3$ | 4-$CH_3$ | 3 | $-CH_2C(CH_3)_2CH_2-$ |
| 21' | 1 | 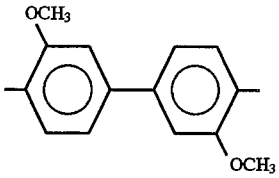 | H | H | 3 | $-CH_2CH_2-$ |
| 22' | 1 | 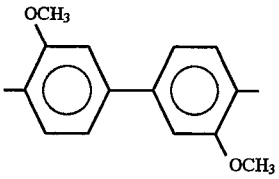 | H | 4-$CH_3$ | 3 | $-CH_2CH_2-$ |
| 23' | 1 | 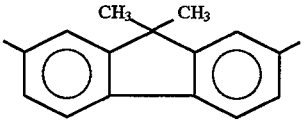 | H | H | 3 | $-CH_2CH_2-$ |
| 24' | 1 | 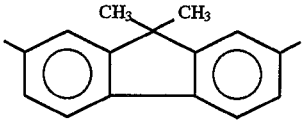 | 2-$CH_3$ | H | 3 | $-CH_2CH_2-$ |
| 25' | 1 | 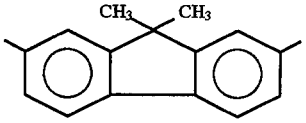 | 3-$CH_3$ | H | 3 | $-CH_2CH_2-$ |
TABLE 16
| No. | k | X | $R_1$ | $R_2$ | BP | T' |
|---|---|---|---|---|---|---|
| 26' | 1 | 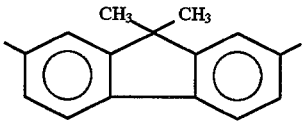 | 4-$CH_3$ | H | 3 | $-CH_2CH_2-$ |
| 27' | 1 | 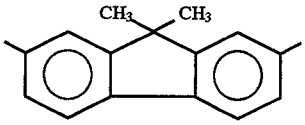 | 3-$CH_3$ | 4-$CH_3$ | 3 | $-CH_2CH_2-$ |
| 28' | 1 | 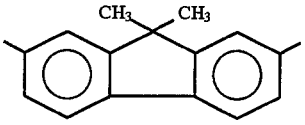 | 3-$CH_3$ | 5-$CH_3$ | 3 | $-CH_2CH_2-$ |

TABLE 16-continued
| No. | k | X | $R_1$ | $R_2$ | BP | T' |
|---|---|---|---|---|---|---|
| 29' | 1 | 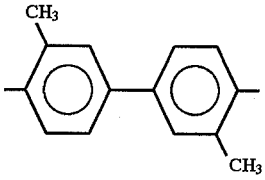 | H | 4-$CH_3$ | 4 | $-CH_2CH_2-$ |
| 30' | 1 | 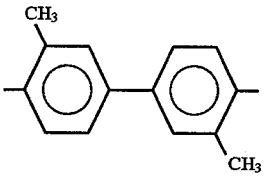 | 3-$CH_3$ | 4-$CH_3$ | 4 | $-CH_2CH_2-$ |
| 31' | 1 | 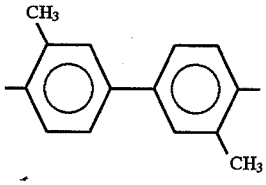 | H | 4-$CH_3$ | 4 | $-CH_2CH_2CH_2-$ |
| 32' | 1 | 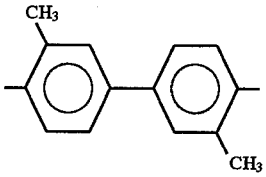 | 3-$CH_3$ | 4-$CH_3$ | 4 | $-CH_2CH_2CH_2-$ |
TABLE 17
| No. | k | $X^1$ | $R_1$ | $R_2$ | BP | T' |
|---|---|---|---|---|---|---|
| 33' | 0 | 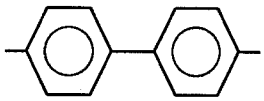 | H | H | 4,4' | $-CH_2-$ |
| 34' | 0 | 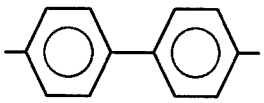 | H | H | 4,4' | $-CH_2CH_2-$ |
| 35' | 0 | 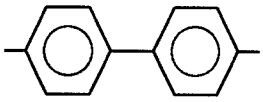 | 3-$CH_3$ | 4-$CH_3$ | 4,4' | $-CH_2-$ |
| 36' | 1 | 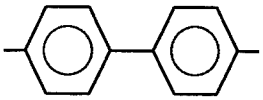 | H | H | 4,4' | $-CH_2-$ |
| 37' | 1 | 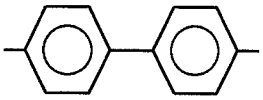 | H | H | 4,4' | $-CH_2CH_2-$ |
| 38' | 1 | 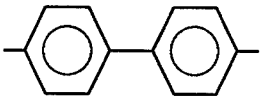 | H | 4-$C_6H_5$ | 4,4' | $-CH_2CH_2-$ |

TABLE 17-continued
| No. | k | $X^1$ | $R_1$ | $R_2$ | BP | T' |
|---|---|---|---|---|---|---|
| 39' | 1 | 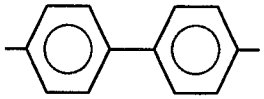 | 3-$CH_3$ | 4-$CH_3$ | 4,4' | $-CH_2-$ |
| 40' | 1 | 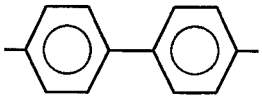 | 4-$CH_3$ | H | 4,4' | $-CH_2CH_2-$ |
| 41' | 1 | 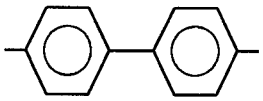 | 3-$CH_3$ | 4-$CH_3$ | 4,4' | $-CH_2CH_2-$ |
| 42' | 1 | 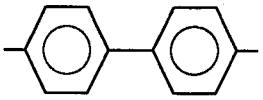 | H | H | 4,4' | $-CH_2CH_2CH_2CH_2-$ |
| 43' | 1 | 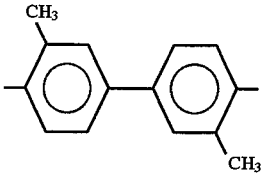 | H | H | 4,4' | $-CH_2CH_2-$ |
| 44' | 1 | 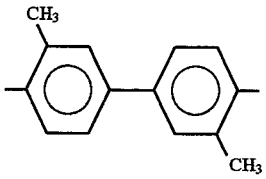 | 2-$CH_3$ | H | 4,4' | $-CH_2CH_2-$ |
TABLE 18
| No. | k | X | $R_1$ | $R_2$ | BP | T' |
|---|---|---|---|---|---|---|
| 45' | 1 | 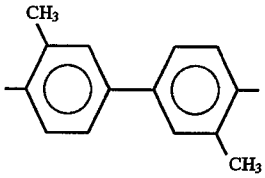 | 3-$CH_3$ | H | 4,4' | $-CH_2CH_2-$ |
| 46' | 1 | 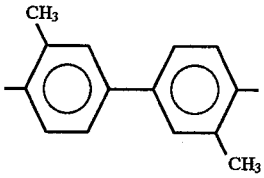 | 4-$CH_3$ | H | 4,4' | $-CH_2CH_2-$ |
| 47' | 1 | 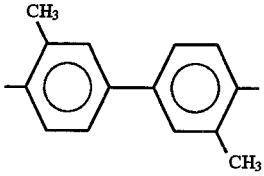 | 3-$CH_3$ | 4-$CH_3$ | 4,4' | $-CH_2CH_2-$ |

TABLE 18-continued
| No. | k | X | $R_1$ | $R_2$ | BP | T |
|---|---|---|---|---|---|---|
| 48' | 1 | 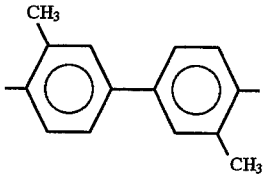 | 3-$CH_3$ | 5-$CH_3$ | 4,4' | $-CH_2CH_2-$ |
| 49' | 1 | 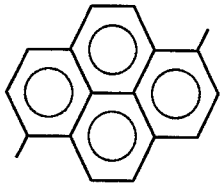 | H | H | 4,4' | $-CH_2CH_2-$ |
| 50' | 0 | 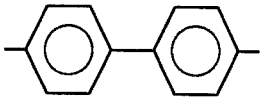 | H | H | 4,4' | $-CH_2C(CH_3)_2CH_2-$ |
| 51' | 0 | 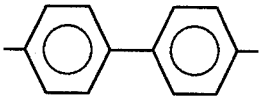 | 3-$CH_3$ | 4-$CH_3$ | 4,4' | $-CH_2C(CH_3)_2CH_2-$ |
TABLE 19
| No. | k | X | $R_1$ | $R_2$ | BP | T |
|---|---|---|---|---|---|---|
| 52' | 1 | 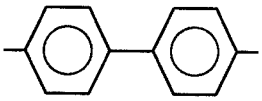 | H | H | 4,4' | $-CH_2C(CH_3)_2CH_2-$ |
| 53' | 1 | 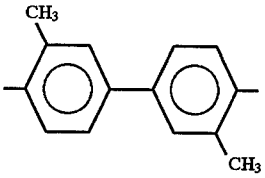 | H | H | 4,4' | $-CH_2C(CH_3)_2CH_2-$ |
| 54' | 1 | 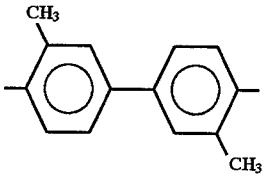 | 3-$CH_3$ | 4-$CH_3$ | 4,4' | $-CH_2C(CH_3)_2CH_2-$ |
| 55' | 1 | 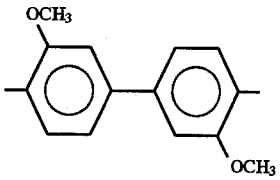 | H | H | 4,4' | $-CH_2CH_2-$ |

TABLE 19-continued
| No. | k | X | $R_1$ | $R_2$ | BP | T' |
|---|---|---|---|---|---|---|
| 56' | 1 | 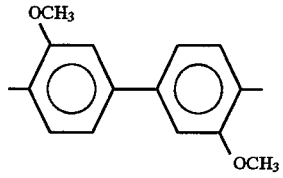 | 4-$CH_3$ | H | 4,4' | $-CH_2CH_2-$ |
| 57' | 1 | 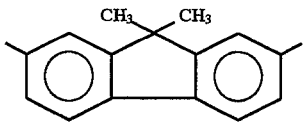 | H | H | 4,4' | $-CH_2CH_2-$ |
| 58' | 1 | 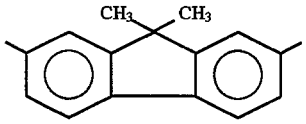 | 2-$CH_3$ | H | 4,4' | $-CH_2CH_2-$ |
TABLE 20
| No. | k | X | $R_1$ | $R_2$ | BP | T' |
|---|---|---|---|---|---|---|
| 59' | 1 | 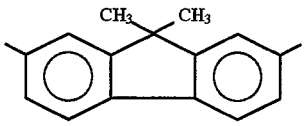 | 3-$CH_3$ | H | 4,4' | $-CH_2CH_2-$ |
| 60' | 1 | 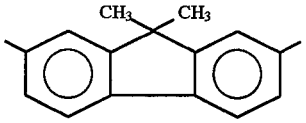 | 4-$CH_3$ | H | 4,4' | $-CH_2CH_2-$ |
| 61' | 1 | 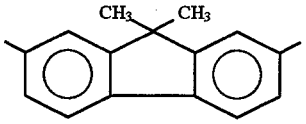 | 3-$CH_3$ | 4-$CH_3$ | 4,4' | $-CH_2CH_2-$ |
| 62' | 1 | 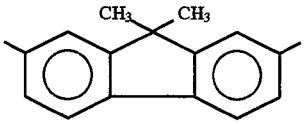 | 3-$CH_3$ | 5-$CH_3$ | 4,4' | $-CH_2CH_2-$ |
TABLE 21
| | monomer(s) | | | | | |
|---|---|---|---|---|---|---|
| No. | No. | r | Y | Z | m | p |
| (1) | 1' | — | $-CH_2CH_2-$ | — | 1 | 240 |
| (2) | 2' | — | $-CH_2CH_2-$ | — | 1 | 250 |
| (3) | 4' | — | $-CH_2CH_2-$ | — | 1 | 170 |
| (4) | 4' | — | $-CH_2CH_2-$ | 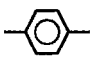 | 1 | 35 |
| (5) | 4' | — | $-CH_2CH_2-$ | 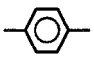 | 2 | 40 |
TABLE 21-continued
| | monomer(s) | | | | | |
|---|---|---|---|---|---|---|
| No. | No. | r | Y | Z | m | p |
| (6) | 4' | — | $-CH_2CH_2-$ | 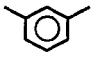 | 1 | 20 |
| (7) | 4' | — | 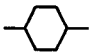 | — | 1 | 35 |
| (8) | 4' | — | 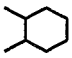 | $-(CH_2)_4-$ | 1 | 15 |

TABLE 21-continued

| monomer(s) No. | No. | r | Y | Z | m | p |
|---|---|---|---|---|---|---|
| (9) | 4' | — | 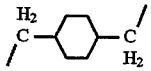 | — | 1 | 30 |
| (10) | 5' | — | $-CH_2CH_2-$ | — | 1 | 185 |
| (11) | 5' | — | $-CH_2CH_2-$ | — | 2 | 55 |
| (12) | 6' | — | $-CH_2CH_2-$ | — | 1 | 200 |
| (13) | 7' | — | $-CH_2CH_2-$ | 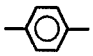 | 1 | 35 |
| (14) | 8' | — | $\leftarrow CH_2 \rightarrow_4$ | $\leftarrow CH_2 \rightarrow_4$ | 1 | 30 |
| (15) | 9' | — | $-CH_2CH_2-$ | — | 1 | 180 |
| (16) | 9' | — | $-CH_2CH_2-$ | 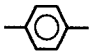 | 1 | 25 |
| (17) | 9' | — | 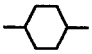 | — | 1 | 30 |

TABLE 22

| monomer(s) No. | No. | r | Y | Z | m | p |
|---|---|---|---|---|---|---|
| (18) | 9' | — | 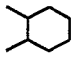 | — | 1 | 25 |
| (19) | 9' | — | 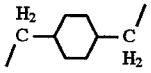 | 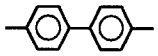 | 1 | 25 |
| (20) | 10' | — | $-CH_2CH_2-$ | — | 1 | 190 |
| (21) | 11' | — | $-CH_2CH_2-$ | 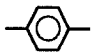 | 1 | 25 |
| (22) | 12' | — | 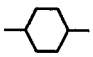 | — | 1 | 35 |
| (23) | 13' | — | 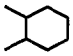 | — | 1 | 30 |
| (24) | 14' | — | 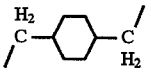 | 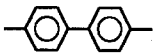 | 1 | 25 |
| (25) | 15' | — | $-CH_2CH_2-$ | — | 1 | 175 |
| (26) | 21' | — | $-CH_2CH_2-$ | — | 1 | 175 |
| (27) | 21' | — | $-CH_2CH_2-$ | 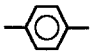 | 1 | 35 |
| (28) | 21' | — | 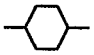 | — | 1 | 35 |
| (29) | 21' | — | 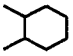 | — | 1 | 30 |
| (30) | 22' | — | 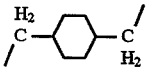 | 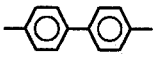 | 1 | 25 |

TABLE 23

| monomer(s) No. | No. | r | Y | Z | m | p |
|---|---|---|---|---|---|---|
| (31) | 23' | — | $-CH_2CH_2-$ | — | 1 | 180 |
| (32) | 23' | — | $-CH_2CH_2-$ | 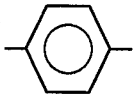 | 1 | 30 |
| (33) | 29' | — | $-CH_2CH_2-$ | — | 1 | 160 |
| (34) | 30' | — | $-CH_2CH_2-$ | — | 1 | 165 |
| (35) | 31' | — | $-CH_2CH_2-$ | — | 1 | 165 |
| (36) | 32' | — | $-CH_2CH_2-$ | — | 1 | 170 |
| (37) | 33' | — | $-CH_2CH_2-$ | — | 1 | 195 |
| (38) | 34' | — | $-CH_2CH_2-$ | — | 1 | 205 |
| (39) | 35' | — | $-CH_2CH_2-$ | — | 1 | 210 |
| (40) | 36' | — | $-CH_2CH_2-$ | — | 1 | 140 |
| (41) | 37' | — | $-CH_2CH_2-$ | — | 1 | 155 |
| (42) | 39' | — | $-CH_2CH_2-$ | — | 1 | 160 |
| (43) | 41' | — | $-CH_2CH_2-$ | — | 1 | 170 |
| (44) | 37' | — | $-CH_2CH_2-$ | 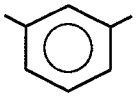 | 1 | 20 |

TABLE 24

| monomer(s) NO. | No. | r | Y | Z | m | p |
|---|---|---|---|---|---|---|
| (45) | 40' | — | $\leftarrow CH_2 \rightarrow_4$ | $\leftarrow CH_2 \rightarrow_4$ | 1 | 30 |
| (46) | 37' | — | 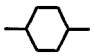 | — | 1 | 165 |
| (47) | 43' | — | $-CH_2CH_2-$ | — | 1 | 200 |
| (48) | 43' | — | $-CH_2CH_2-$ | 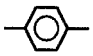 | 1 | 25 |
| (49) | 43' | — | 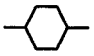 | — | 1 | 190 |
| (50) | 44' | — | $-CH_2CH_2-$ | — | 1 | 160 |
| (51) | 45' | — | $-CH_2CH_2-$ | — | 1 | 25 |
| (52) | 46' | — | 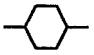 | — | 1 | 185 |
| (53) | 47' | — | 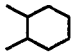 | — | 1 | 160 |
| (54) | 49' | — | $-CH_2CH_2-$ | — | 1 | 170 |
| (55) | 51' | — | $-CH_2CH_2-$ | 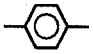 | 1 | 35 |
| (56) | 52' | — | 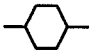 | — | 1 | 160 |
| (57) | 53' | — | 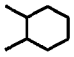 | — | 1 | 150 |
| (58) | 54' | — | 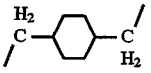 | 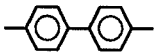 | 1 | 25 |

TABLE 25

| No. | monomer(s) No. | r | Y | Z | m | p |
|---|---|---|---|---|---|---|
| (59) | 55' | — | $-CH_2CH_2-$ | — | 1 | 190 |
| (60) | 55' | — | $-CH_2CH_2-$ | 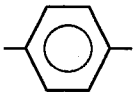 | 1 | 30 |
| (61) | 55' | — | 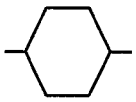 | — | 1 | 170 |
| (62) | 55' | — | 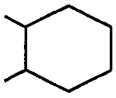 | — | 1 | 160 |
| (63) | 56' | — | 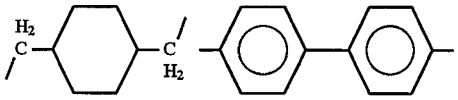 | | 1 | 25 |
| (64) | 4' | — | $-CH_2-C(CH_3)_2-CH_2-$ | — | 1 | 185 |
| (65) | 30' | — | $-CH_2-C(CH_3)_2-CH_2-$ | — | 1 | 135 |
| (66) | 16' | — | 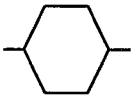 | — | 1 | 200 |
| (67) | 18' | — | $-CH_2CH_2-$ | — | 1 | 110 |
| (68) | 20' | — | $-CH_2CH_2-$ | 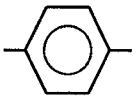 | 1 | 95 |
| (69) | 4'/12' | 1/1 | $-CH_2CH_2-$ | — | 1 | 195 |
| (70) | 4'/12' | 1/1 | $-CH_2CH_2-$ | — | 2 | 160 |

TABLE 26

| No. | monomer(s) No. | r | Y | Z | m | p |
|---|---|---|---|---|---|---|
| (71) | 4'/12' | 1/1 | 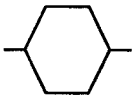 | — | 1 | 155 |
| (72) | 4'/12' | 1/1 | $-CH_2CH_2-$ | 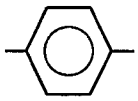 | 1 | 30 |
| (73) | 4'/30' | 1/1 | $-CH_2CH_2-$ | — | 1 | 200 |
| (74) | 4'/30' | 1/1 | $-CH_2CH_2-$ | — | 2 | 145 |
| (75) | 4'/31' | 1/1 | $-CH_2CH_2-$ | — | 1 | 170 |
| (76) | 4'/8'/30' | 1/1/1 | $-CH_2CH_2-$ | — | 1 | 195 |
| (77) | 8'/30' | 1/1 | $-CH_2CH_2-$ | — | 1 | 205 |

TABLE 26-continued

| No. | monomer(s) No. | r | Y | Z | m | p |
|---|---|---|---|---|---|---|
| (78) | 8'/30' | 1/1 | $-CH_2CH_2-$ | 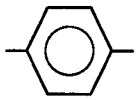 | 1 | 35 |
| (79) | 8'/30' | 1/2 | $-CH_2CH_2-$ | — | 1 | 200 |
| (80) | 8'/30' | 2/1 | $-CH_2CH_2-$ | — | 1 | 200 |

The photoreceptor according to the second embodiment of the present invention is described in detail below mainly with reference to one having a functionally-separated laminated structure.

Examples of the electrically-conductive support include metals such as aluminum, nickel, chromium and stainless steel; plastic films having therein provided a thin film of aluminum, titanium, nickel, chromium, stainless steel, gold, vanadium, tin oxide, indium oxide and ITO; and paper or plastic films coated or impregnated with an electrically conducting agent. The electrically-conductive support for use in the second embodiment of present invention may be used in an appropriate form such as drum, sheet and plate, but is not limited to these forms. If necessary, the surface of the electrically-conductive support may be subjected to various treatments so long as the image quality cannot be impaired. Examples of these treatments include oxidation, chemical treatment, coloring, and treatment for providing irregular reflection such as graining.

Further, an undercoating layer may be provided between the electrically-conductive support and the charge-generating layer. The undercoating layer acts to prevent the injection of electric charge from the electrically-conductive support into the laminated photosensitive layer upon charging of the photosensitive layer. The undercoating layer also acts as an adhesive layer for integrating the photosensitive layer with the electrically-conductive support. In some cases, the undercoating layer acts to prevent the electrically-conductive support from reflecting light. Examples of the material for use in the undercoating layer include known materials such as polyethylene resins, polypropylene resins, acryl resins, methacryl resins, polyamide resins, vinyl chloride resins, vinyl acetate resins, phenol resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acids, starch, starch acetate, aminostarch, polyacrylic acids, polyacrylamides, zirconium chelate compounds, titanyl chelate compounds, titanyl alkoxide compounds, organic titanyl compounds and silane coupling agents. These materials may be used alone or in combination of two or more thereof.

Further, a particulate material such as fine particles of titanium oxide, silicon oxide, zirconium oxide, barium titanate and silicone resin may be used in admixture. The addition amount of these particulate materials are generally from 10 to 60% by weight based on the weight of the undercoating layer. The thickness of the undercoating layer is generally from 0.01 to 10 μm, preferably from 0.05 to 2 μm.

Examples of the charge-generating material for use in the charge-generating layer according to the second embodiment of the present invention include inorganic photoconductive materials such as amorphous selenium, crystalline selenium-tellurium alloy, selenium-arsenic alloy, other selenium compounds and selenium alloys, zinc oxide, and titanium oxide; and organic pigments and dyes such as phthalocyanine compounds, squarylium compounds, anthanthrone compounds, perylene compounds, azo compounds, anthraquinone compounds, pyrene compounds, pyrylium compounds and thiapyrylium salts.

Examples of the binder resin for use in the charge-generating layer include polyvinyl butyral resins, polyvinyl formal resins, partially-modified polyvinyl acetal resins, polycarbonate resins, polyester resins, acryl resins, polyvinyl chloride resins, polystyrene resins, polyvinyl acetate resins, vinyl chloride-vinyl acetate copolymers, silicone resins, phenol resins and poly-N-vinyl carbazole resins, but are not limited to these compounds. These binder resins may be used alone or two or more thereof may be used in admixture.

The mixing ratio (by weight) of the charge-generating material to the binder resin is preferably from 10:1 to 1:10. The thickness of the charge-generating layer for use in the second embodiment of the present invention is generally from 0.1 to 5.0 μm, preferably from 0.2 to 2.0 μm.

In the second embodiment of the present invention, the charge-transporting layer may be formed from the above described charge-transporting polyester. In this case, the charge-transporting layer preferably further comprises a polycarbonate resin having at least one repeating structural unit selected from the group consisting of those represented by the above described formulae (A) to (E). The mixing ratio (by weight) of the charge-transporting polyester to the polycarbonate resin is preferably from 1:1 to 5:1.

The charge-transporting layer can be formed by a process which comprises dissolving the above described charge-transporting polyester alone or a mixture thereof with the polycarbonate resin in an appropriate solvent, applying the solution to a support, and then drying the coated material. Examples of the solvent for use in the formation of the charge-transporting layer include aromatic hydrocarbons such as benzene, toluene, xylene and chlorobenzene, ketones such as acetone and 2-butanone, halogenated aliphatic hydrocarbons such as methylene chloride, chloroform and ethylene chloride, cyclic or straight-chain ethers such as tetrahydrofuran, dioxane, ethylene glycol and diethyl ether, and mixture thereof. Examples of the coating method for use herein include ordinary coating methods such as blade coating method, wire bar coating method, spray coating method, dip coating method, bead coating method, air knife coating method and curtain coating method.

The thickness of the charge-transporting layer is generally from 2 to 100 μm, preferably from 10 to 40 μm.

The charge-transporting layer may comprise additives such as oxidation inhibitor and light stabilizer incorporated therein for inhibiting the deterioration of the photoreceptor due to light, heat, etc. Examples of the oxidation inhibitor include hindered phenols, hindered amines, paraphenylenediamine derivatives, arylalkanes, hydroquinone derivatives, organic sulfur compounds and organic phosphorus compounds. Examples of the light stabilizer include benzophenone, benzotriazole, dithiocarbamate, tetramethylpiperidine and derivatives thereof. These additives may be used alone, or two or more thereof may be used in admixture. These additives may be contained in an amount of generally from 0.01 to 20% by weight, preferably from 0.1 to 10% by weight based on the weight of the charge-transporting polyester.

The charge-transporting layer may further comprise an additive known as a coating modifier for the main purpose of obtaining good surface properties. Preferred examples of the coating modifier include dimethyl polysiloxanes (e.g., dimethyl silicone oil) and methylphenyl polysiloxanes (e.g., methylphenyl silicone oil). Other preferred examples of the coating modifier include modified silicone oils obtained by partially modifying these polysiloxanes with an alkyl group, an alkoxy group, an alkylallyl group, glycol, an alcohol, an epoxy group, a methylstyryl group, a higher aliphatic acid group or a polyether. The addition amount of the coating modifier is generally from 1 to 10,000 ppm, preferably from 5 to 2,000 rpm based on the solid content of the charge-transporting layer.

The charge-transporting layer may further comprise at least one electron acceptor for enhancing sensitivity and for reducing residual potential and fatigue upon repeated use, etc. Examples of the electron acceptor include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. The addition amount of the electron acceptor is generally from 0.01 to 10% by weight, preferably from 0.1 to 5% by weight based on the weight of the charge-transporting layer.

In the second embodiment of the present invention, it is also preferred to provide the layer comprising the above described charge-transporting polymer as a protective layer on a charge-transporting layer comprising other charge-transporting materials. The charge-transporting layer for use in such a case may comprise a binder resin and a known low molecular weight charge-transporting material molecularly dispersed therein.

Examples of the low molecular weight charge-transporting material for use herein include oxadiazole derivatives such as 2,5-bis(p-diethylaminophenol)-1,3,4-oxadiazole, pyrazolidone derivatives such as 1,3,5-triphenylpyrazoline, aromatic tertiary amino compounds such as triphenylamine, aromatic tertiary diamine compounds such as N,N'-diphenyl-N,N'-bis(3-methylphenyl)-[1,1'-biphenyl]-4,4'-diamine, 1,2,4-triazine derivatives such as 3-(4'-diethylaminophenyl)-5,6-di(4'-methoxyphenyl)-1,2,4-triazine, hydrazone derivatives such as 4-diethylaminobenzaldehyde-1,1'-diphenylhydrazone, quinazoline derivatives such as 2-phenyl-4-styrylquinazoline, benzofuran derivatives such as 6-hydroxy-2,3-di(p-methoxyphenyl)benzofuran, and α-stilbene derivatives such as p-(2,2'-diphenylvinyl)-N,N-diphenylaniline. Examples of the binder resin for use herein include (modified) polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinyl chloride-vinyl acetate-maleic anhydride copolymers, silicone resins, silicone-alkyd resins, phenol-formaldehyde resins and styrene-alkyd resins.

The above described charge-transporting layer may be provided in a manner similar to the charge-transporting layer comprising the above described charge-transporting polyester or a mixture of the charge-transporting polyester and the polycarbonate. The weight ratio of the charge-transporting material to the binder resin is from 10:1 to 1:5. The thickness of the charge-transporting layer is generally from 5 to 50 μm, preferably from 10 to 30 μm. In this arrangement, the thickness of the protective layer comprising a charge-transporting polyester is generally from 1 to 200%, preferably from 5 to 100% of that of the charge-transporting layer.

The charging apparatus for use in the image forming apparatus according to the second embodiment of the present invention is described below. The electrically-conductive member in the charging apparatus may be in any form of brush, blade, pin electrode or roller. Preferred among these forms is roller. In general, a roller-shaped member comprises a resistive layer as an outermost layer, an elastic layer for supporting the resistive layer, and a core material. A protective layer may be provided on the external surface of the resistive layer as needed.

The core material is electrically conductive. In general, iron, copper, brass, stainless steel, aluminum, nickel, etc. are used. Alternatively, a formed resin product having a particulate electrically-conductive material dispersed therein may be used. The material of the elastic layer is electrically conductive or semiconducting. The elastic layer generally comprises a rubber material and a particulate electrically-conductive or semiconducting material dispersed therein. Examples of the rubber material for use herein include EPDM, polybutadiene, natural rubbers, polyisobutylene, SBR, CR, NBR, silicone rubbers, urethane rubbers, epichlorohydrin rubber, SBS, thermoplastic elastomers, norbornene rubber, fluorosilicone rubbers and ethylene oxide rubbers. Examples of the particulate electrically-conductive or semiconducting material include carbon black, metals such as zinc, aluminum, copper, iron, nickel, chromium and titanium, and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO. These materials may be used alone, or two or more thereof may be used in admixture. The particulate electrically-conductive or semiconducting material is generally contained in the elastic layer in an amount of from 10 to 70% by weight, preferably 30 to 60% by weight based on the weight of the elastic layer.

The material of the resistive layer and the protective layer for the charging apparatus comprises a binder resin and a particulate electrically-conductive or semiconducting material dispersed therein to have a properly-controlled resistivity. The resistivity of the resistive layer and the protective layer may be predetermined to a range of from $10^3$ to $10^{14}$ Ω·cm, preferably from $10^5$ to $10^{12}$ Ω·cm, more preferably from $10^7$ to $10^{12}$ Ω·cm. The thickness of the resistive layer and the protective layer may be predetermined to a range of from 0.01 to 1,000 μm, preferably from 0.1 to 500 μm, more preferably from 0.5 to 100 μm.

Examples of the binder resin for use herein include acrylic resins, cellulose resins, polyamide resins, methoxymethylenated nylons, ethoxymethylated nylons, polyurethane resins, polycarbonate resins, polyester resins, polyethylene resins, polyvinyl resins, polyarylate resins, polythiophene resins, polyethylene terephtalate (PET), polyolefin resins and styrenebutadiene resins.

The same carbon black, metal and metal oxide as in the elastic layer may be used as the particulate electrically-conductive or semiconducting material for the resistive layer and the protective layer for the charging apparatus.

The resistive layer or protective layer may comprise an oxidation inhibitor such as hindered phenol and hindered amine, a filler such as clay and kaolin and a lubricant such as silicone oil as needed. Examples of the method for forming these layers include blade coating method, wire bar coating method, spray coating method, dip coating method, bead coating method, air knife coating method, curtain coating method, vacuum evaporation method, and plasma coating method.

In the case where the above described photoreceptor is electrically charged in the image forming apparatus equipped with the charging apparatus comprising such an electrically-conductive member, a voltage is applied to the electrically-conductive member. The voltage to be applied preferably comprises a d.c. voltage and an a.c. voltage superposed thereon. With a d.c. voltage alone, a uniform charging cannot be provided.

The d.c. voltage preferably ranges from 50 to 2,000 V, particularly from 100 to 1,500 V, either positive or negative. The a.c. voltage to be superposed on the d.c. voltage ranges from 400 to 1,800 V, preferably from 800 to 1,600 V, more preferably from 1,200 to 1,800 V, as calculated in terms of peak-to-peak value. If this peak-to-peak voltage exceeds 1,800 V, it becomes more difficult to provide a uniform charging than the d.c. voltage alone. The frequency of the a.c. voltage is preferably from 100 to 2,000 Hz.

The present invention will be described in detail below with reference to the following Examples, but the present invention should not be construed as being limited thereto. The parts are by weight unless otherwise indicated.

(I) Examples according to the first embodiment of the present invention are described below.

SYNTHESIS EXAMPLE 1

Synthesis of Charge-transporting Polyester No. 90

10 g of a methyl ester of monomer 22, 20 g of ethylene glycol and 0.1 g of tetrabutoxy titanium were charged into a 500-ml flask. The mixture was then heated under reflux in a stream of nitrogen for 3 hours. Thereafter, the pressure of the reaction system was reduced to 0.5 mmHg where ethylene glycol was then distilled off. The reaction system was allowed to cool to room temperature. The reaction mixture was then dissolved in 200 ml of methylene chloride. To the solution was then added dropwise a solution of 2.63 g of phthalic dichloride in 100 ml of methylene chloride. To the reaction mixture was then added 5.0 g of triethylamine. The reaction mixture was then heated under reflux for 30 minutes. To the reaction mixture was then added 3 ml of methanol. The reaction mixture was then heated under reflux for 30 minutes. The insoluble matter was then removed by filtration. The filtrate was then added dropwise to 1,000 ml of ethanol with stirring to cause a polymer to be precipitated. The polymer thus precipitated was picked up by filtration, dissolved in 500 ml of THF, and then added dropwise to 1,500 ml of water with stirring to cause the polymer to be precipitated. The polymer thus obtained was picked up by filtration, thoroughly washed with ethanol, and then dried to obtain 9.0 g of a charge-transporting polymer. The molecular weight (Mw) of the charge-transporting polyester was $3.35\times10^4$ in styrene equivalence as determined by GPC. The polymerization degree (p) of the charge-transporting polyester was about 35.

SYNTHESIS EXAMPLE 2

Synthesis of Charge-transporting Polyester No. 91

10 g of a methyl ester of monomer 5, 20 g of ethylene glycol and 0.1 g of tetrabutoxy titanium were charged into a 50-ml flask. The mixture was then heated under reflux in a stream of nitrogen for 2 hours. Thereafter, the pressure of the reaction system was reduced to 0.5 mmHg where the reaction system was then heated to a temperature of 230° C. while ethylene glycol was being distilled off. The reaction lasted for 5 hours. The reaction system was allowed to cool to room temperature. The reaction mixture was then dissolved in 250 ml of methylene chloride. The insoluble matter was then removed by filtration. The filtrate was then added dropwise to 1,500 ml of ethanol with stirring to cause a polymer to be precipitated. The polymer thus precipitated was picked up by filtration, thoroughly washed with ethanol, and then dried to obtain 10.0 g of a charge-transporting polyester. The molecular weight (Mw) of the charge-transporting polyester was $1.30\times10^5$ in styrene equivalence as determined by GPC. The polymerization degree (p) of the charge-transporting polyester was about 190.

SYNTHESIS EXAMPLE 3

30 parts of 1,3-diiminoisoindolin and 9.1 parts of gallium trichloride were added to 230 parts of quinoline. The mixture was then allowed to undergo reaction at a temperature of 200° C. for 3 hours. The reaction product was picked up by filtration, and then washed with acetone and methanol. The resulting wet cake was then dried to obtain 28 parts of a crystalline chlorogallium phthalocyanine. 3 parts of the crystalline chlorogallium phthalocyanine thus obtained were then dry-ground by means of an automatic mortar (Type Lab-Mill UT-21, available from Yamato Kagaku K.K.) for 3 hours. 0.5 parts of the crystalline chlorogallium phthalocyanine thus ground were then subjected to milling with 60 parts of glass beads (diameter: 1 mm) in 20 parts of benzyl alcohol at room temperature for 24 hours. The glass beads were then removed by filtration. The filtrate was washed with 10 parts of methanol, and then dried to obtain a crystalline chlologallium phthalocyanine having intense diffraction peaks at $2\theta\pm0.2°=7.4°$, 16.6°, 25.5° and 28.3° in powder X-ray diffraction spectrum. This product was referred to as CG-1.

SYNTHESIS EXAMPLE 4

50 g of phthalonitrile and 27 g of stannic chloride anhydride were added to 350 ml of 1-chloronaphthalene. The mixture was then allowed to undergo reaction at a temperature of 195° C. for 5 hours. The reaction product was picked up by filtration, washed with 1-chloronaphthalene, acetone, methanol and then water, and then dried under reduced pressure to obtain 18.3 g of a crystalline dichlorotin phthalocyanine. 5 g of the crystalline dichlorotin phthalocyanine thus obtained were then charged into an agate pot with 10 g of sodium chloride and 500 g of agate balls (diameter: 20 mm). The crystalline dichlorotin phthalocyanine was subjected to grinding at 400 rpm by means of a planetary ball mill (P-5, available from Fritz) for 10 hours, thoroughly washed with water, and then dried. 0.5 g of the product was then subjected to milling with 15 g of tetrahydrofuran (THF) and 30 g of glass beads (diameter: 1 mm) at room temperature for 24 hours. The glass beads were then removed by filtration. The filtrate was washed with methanol, and then dried to obtain a crystalline dichlorotin phthalocyanine having intense diffraction peaks at $2\theta\pm0.2°=8.5°$, 11.2°, 14.5° and 27.2° in powder X-ray diffraction spectrum. This product was referred to as CG-2.

SYNTHESIS EXAMPLE 5

3 parts of the crystalline chlorogallium phthalocyanine obtained in Synthesis Example 3 were dissolved in 60 parts of concentrated sulfuric acid at a temperature of 0° C. The solution was then added dropwise to 450 parts of distilled water at a temperature of 5° C. to cause the crystal to be re-precipitated. The crystal was washed with distilled water, dilute aqueous ammonia, etc., and then dried to obtain 2.5 parts of a crystalline hydroxygallium phthalocyanine. The crystal was then ground by means of an automatic mortar for 5.5 hours. 0.5 parts of the product were then subjected to milling with 15 parts of dimethylformamide and 30 parts of glass beads having a diameter of 1 mm for 24 hours. Thereafter, the crystal was picked up, washed with methanol, and then dried to obtain a crystalline hydroxygallium phthalocyanine having intense diffraction peaks at $2\theta\pm0.2°=7.5°$, 9.9°, 12.5°, 16.3°, 18.6°, 25.1° and 28.3° in powder X-ray diffraction spectrum. This product was referred to as CG-3.

SYNTHESIS EXAMPLE 6

30 parts of 1,3-diiminoisoindolin and 17 parts of titanium tetrabutoxide were added to 200 parts of 1-chloronaphthalene. The mixture was then allowed to undergo reaction in a stream of nitrogen at a temperature of 190° C. for 5 hours. The reaction product was picked up by filtration, and then washed with aqueous ammonia, water and acetone to obtain 40 parts of titanyl phthalocyanine. 5 parts of the crystalline titanyl phthalocyanine thus obtained were then subjected to grinding with 10 parts of sodium chloride by means of an automatic mortar (Type Lab-Mill UT-21, available from Yamato Kagaku K.K.) for 3 hours. Thereafter, the product was thoroughly washed with distilled water, and then dried to obtain 4.8 parts of a crystalline titanyl phthalocyanine. The crystalline titanyl phthalocyanine thus obtained exhibited a definite peak at 27.3°. 2 parts of the crystalline titanyl phthalocyanine thus obtained were then stirred in a mixed solution of 20 parts of distilled water and 2 parts of monochlorobenzene at a temperature of 50° C. for 1 hour. The product was picked up by filtration, thoroughly washed with methanol, and then dried to obtain a crystalline titanyl phthalocyanine hydrate having an intense diffraction peak at 2θ±0.2°=27.3° in powder X-ray diffraction spectrum. This product was referred to as CG-4.

EXAMPLE 1

A solution of 10 parts of a zirconium compound (Orgatics ZC540, available from Matsumoto Chemical Industry Co., Ltd.) and 1 part of a silane compound (A110, available from Nippon Unicar Co., Ltd.) in a mixture of 40 parts of isopropanol and 20 parts of butanol was applied to an aluminum substrate by a dip coating method. The coated material was then heated and dried at a temperature of 150° C. for 10 minutes to form an undercoating layer having a thickness of 0.5 μm. Subsequently, 1 part of CG-1 was mixed with 1 part of a polyvinyl butyral resin (S-Lec BM-S, available from Sekisui Chemical Co., Ltd.) and 100 parts of n-butyl acetate. The mixture was then subjected to dispersion with glass beads by means of a paint shaker for 1 hour. The resulting coating solution was then applied to the above described undercoating layer by a dip coating method. The coated material was then heated and dried at a temperature of 100° C. for 10 minutes to form a charge-generating layer.

Subsequently, 2 parts of the charge-transporting polyester (91) were dissolved in 15 parts of monochlorobenzene. The resulting coating solution was then applied onto the charge-generating layer, which had been formed on the aluminum substrate, by a dip coating method. The coated material was then heated and dried at a temperature of 120° C. for 1 hour to form a charge-transporting layer having a thickness of 15 μm.

The electrophotographic photoreceptor thus obtained was then measured for electrophotographic properties by means of an electrostatic copying paper tester (Electrostatic Analyzer EPA-8100, available from Kawaguchi Denki K.K.). The electrophotographic photoreceptor was subjected to corona discharge treatment at −6 KV in an atmosphere of normal temperature and humidity (20° C., 40% RH), and then irradiated with light from a tungsten lamp which had been adjusted by a monochromator such that the monochromatic light had a wavelength of 800 nm and an intensity of 1 μW/cm$^2$ on the surface of the photoreceptor. The electrophotographic photoreceptor was then measured for surface potential $V_0$ (volt) and half-exposure E½ (erg/cm$^2$). The electrophotographic photoreceptor was irradiated with white light of 10 lux for 1 second, and then measured for residual potential $V_{RP}$ (volt). The above described charging and exposure were repeated 1,000 times. The electrophotographic photoreceptor was then measured for $V_0$, E½ and $V_{RP}$. The change in $V_0$, E½ and $V_{RP}$ were represented in $\Delta V_0$, ΔE½ and $\Delta V_{RP}$, respectively. The results are shown in Table 27. Separately, a photosensitive layer was formed on an aluminum pipe in the same manner as above to form a photosensitive drum. Using a laser beam printer (available from Fuji Xerox Co., Ltd.) equipped with this photosensitive drum, 1,000 sheets of copying were conducted. The quality of images after 1,000 sheets of copying was evaluated. The results are set forth in Table 27.

EXAMPLES 2–11

Electrophotographic photoreceptors were prepared in the same manner as in Example 1 except that either or both of the charge-generating material and the charge-transporting material used in Example 1 were replaced with material(s) as shown in Table 27, respectively. The electrophotographic photoreceptors thus prepared were then evaluated in the same manner as in Example 1. The results are set forth in Table 27.

EXAMPLE 12

An electrophotographic photoreceptor was prepared in the same manner as in Example 1 except that 1.2 parts of the charge-transporting polyester (91) and 0.8 parts of a binder resin comprising a repeating structural unit represented by the structural formula (XI) were used instead of 2 parts of the charge-transporting polyester (91) used in Example 1. The electrophotographic photoreceptor thus prepared was then evaluated in the same manner as in Example 1. The results are shown in Table 27.

COMPARATIVE EXAMPLE 1

An electrophotographic photoreceptor was prepared in the same manner as in Example 1 except that 2 parts of a polyvinyl carbazole (PVK) were used instead of the charge-transporting polyester (91), and CG-2 was used instead of CG-1. The electrophotographic photoreceptor thus prepared was then evaluated in the same manner as in Example 1. The results are shown in Table 27.

TABLE 27

| Example | Charge-transporting | Charge-generating | Initial properties (1st) | | | Maintenance properties (1000th) | | | Stability | Durability | | Image quality after 1000 |
|---|---|---|---|---|---|---|---|---|---|---|---|---|
| Nos. | material | material | $V_0$ | E½ | $V_{RP}$ | $V_0$ | E½ | $V_{RP}$ | ΔE½ | $\Delta V_0$ | $\Delta V_{RP}$ | cycles |
| Example 1 | 91 | CG-1 | −815 | 2.5 | −20 | −801 | 3.1 | −35 | 0.6 | 14 | 15 | Some corruption |
| Example 2 | 85 | CG-1 | −817 | 2.5 | −27 | −802 | 3.1 | −44 | 0.6 | 15 | 17 | Some fogging |
| Example 3 | 90 | CG-1 | −803 | 2.6 | −23 | −783 | 3.2 | −39 | 0.6 | 20 | 16 | Good |
| Example 4 | 108 | CG-1 | −814 | 2.5 | −24 | −800 | 3.1 | −38 | 0.6 | 14 | 14 | Good |
| Example 5 | 85 | CG-2 | −813 | 3.0 | −29 | −799 | 3.5 | −44 | 0.5 | 14 | 14 | Good |
| Example 6 | 93 | CG-2 | −815 | 3.0 | −28 | −800 | 3.5 | −44 | 0.5 | 15 | 16 | Good |
| Example 7 | 118 | CG-2 | −810 | 2.2 | −24 | −795 | 3.5 | −39 | 0.5 | 15 | 15 | Good |
| Example 8 | 94 | CG-3 | −820 | 2.2 | −39 | −803 | 2.5 | −50 | 0.3 | 17 | 11 | Some fogging |
| Example 9 | 95 | CG-3 | −819 | 2.2 | −29 | −805 | 2.5 | −45 | 0.3 | 14 | 16 | Good |
| Example 10 | 96 | CG-3 | −811 | 2.2 | −23 | −795 | 2.5 | −38 | 0.3 | 16 | 15 | Good |

TABLE 27-continued

| Example Nos. | Charge-transporting material | Charge-generating material | Initial properties (1st) $V_0$ | E½ | $V_{RP}$ | Maintenance properties (1000th) $V_0$ | E½ | $V_{RP}$ | Stability $\Delta E½$ | Durability $\Delta V_0$ | $\Delta V_{RP}$ | Image quality after 1000 cycles |
|---|---|---|---|---|---|---|---|---|---|---|---|---|
| Example 11 | 85 | CG-4 | −810 | 1.2 | −18 | −799 | 1.4 | −33 | 0.2 | 12 | 16 | Good |
| Example 12 | 91 + (XI) | CG-1 | −820 | 2.6 | −24 | −803 | 3.2 | −39 | 0.6 | 17 | 15 | Some fogging |
| Comparative Example 1 | PVK | CG-2 | −834 | 3.4 | −46 | −801 | 4.2 | −76 | 0.8 | 33 | 30 | Image defects on entire surface |

The above described charge-transporting polyester according to the first embodiment of the present invention is excellent in solubility and film-forming properties. The ionization potential of the charge-transporting polyester of the present invention can be freely controlled. The organic electronic device comprising the charge-transporting polyester of the present invention is excellent in charge-transporting properties and mechanical abrasion resistance. In particular, the organic electronic device, if it is in the form of electrophotographic photoreceptor, exhibits a high photosensitivity and an excellent repetition stability as can be seen in the results of the above described examples.

(II) Examples according to the second embodiment of the present invention are described below.

The charge-transporting polyesters used were synthesized in the following manners:

SYNTHESIS EXAMPLE 7

Synthesis of Exemplified Compound (34)

2.0 g of 3,3'-dimethyl-N,N'-bis(3,4-dimethylphenyl)-N,N'-bis[4-(2-methoxycarbonylethyl)phenyl]-[1,1'-biphenyl]-4,4'-diamine, 4.0 g of ethylene glycol and 0.1 g of tetrabutoxy titanium were charged into a 50-ml flask. The mixture was then heated under reflux in a stream of nitrogen for 3 hours. After the consumption of 3,3'-dimethyl-N,N'-bis(3,4-dimethylphenyl)-N,N'-bis[4-(2-methoxycarbonylethyl)phenyl]-[1,1'-biphenyl]-4,4'-diamine was confirmed, the pressure of the reaction system was reduced to 0.5 mmHg where the reaction system was then heated to a temperature of 230° C. while ethylene glycol was being distilled off. The reaction lasted for 3 hours under these conditions. Thereafter, the reaction system was allowed to cool to room temperature. The reaction mixture was then dissolved in 50 ml of methylene chloride. The reaction mixture was then filtered to remove insoluble matters. The resulting filtrate was then added dropwise to 250 ml of ethanol with stirring to allow a polymer to be precipitated. The polymer thus obtained was picked up by filtration, thoroughly washed with ethanol, and then dried to obtain 1.9 g of a charge-transporting polyester. The molecular weight (Mw) of the charge-transporting polyester was $1.23\times10^5$ in styrene equivalence as determined by GPC. The polymerization degree (p) of the charge-transporting polyester determined from the molecular weight of the monomer was about 165.

SYNTHESIS EXAMPLE 8

Synthesis of Exemplified Compound (44)

1.0 g of N,N'-diphenyl-N,N'-bis[4-(4-ethoxycarbonyl ethylphenyl)-phenyl)-[1,1'-biphenyl]-4,4'-diamine, 2.0 g of ethylene glycol and 0.05 g of tetrabutoxy titanium were charged into a 50-ml flask. The mixture was then heated under reflux in a stream of nitrogen for 3 hours. After the consumption of N,N'-diphenyl-N,N'-bis[4-(4-ethoxycarbonylethylphenyl)-phenyl)-[1,1'-biphenyl]-4,4'-diamine was confirmed, the pressure of the reaction system was reduced to 0.5 mmHg where ethylene glycol was distilled off. Thereafter, the reaction system was allowed to cool to room temperature. The reaction mixture was then dissolved in 20 ml of methylene chloride. To the reaction mixture was then added dropwise a solution of 0.24 g of dichloride isophthalate in 10 ml of methylene chloride. To the reaction mixture was then added 0.48 g of triethylamine. The reaction mixture was then heated under reflux for 30 minutes. To the reaction mixture was then added 0.3 ml of methanol. The reaction mixture was then heated under reflux for 30 minutes. The reaction mixture was then filtered to remove insoluble matters. The resulting filtrate was then added dropwise to 300 ml of ethanol with stirring to allow a polymer to be precipitated. The polymer thus obtained was picked up by filtration, dissolved in 50 ml of tetrahydrofuran (THF), and then added dropwise to 300 ml of water with stirring to allow a polymer to be precipitated. The polymer thus obtained was picked up by filtration, thoroughly washed with ethanol, and then dried to obtain 0.9 g of a charge-transporting polyester. The molecular weight (Mw) of the charge-transporting polyester was $1.60\times10^4$ in styrene equivalence as determined by GPC. The polymerization degree p of the charge-transporting polyester determined from the molecular weight of the monomer was about 20.

SYNTHESIS EXAMPLE 9

Synthesis of Exemplified Compound (73)

5.0 g of N,N'-diphenyl-N,N'-bis[3-(2-ethoxycarbonyl ethylphenyl)-phenyl]-[1,1'-biphenyl]-4,4'-diamine, 5.4 g of 3,3'-dimethyl-N,N'-bis(3,4-dimethylphenyl)-N,N'-bis[4-(2-methoxycarbonylethyl)phenyl]-[1,1'-biphenyl]-4,4'-diamine, 20 g of ethylene glycol and 0.1 g of tetrabutoxy titanium were charged into a 50-ml flask. The mixture was then heated under reflux in a stream of nitrogen for 2 hours. The pressure of the reaction system was reduced to 0.5 mmHg where the reaction system was then heated to a temperature of 230° C. while ethylene glycol was being distilled off. The reaction lasted for 5 hours under these conditions. Thereafter, the reaction system was allowed to cool to room temperature. The reaction mixture was then dissolved in 250 ml of methylene chloride. The reaction mixture was then filtered to remove insoluble matters. The resulting filtrate was then added dropwise to 150 ml of ethanol with stirring to allow a polymer to be precipitated. The polymer thus obtained was picked up by filtration, thoroughly washed with ethanol, and then dried to obtain 10.1 g of a charge-transporting polyester. The molecular weight (Mw) of the charge-transporting polyester was $1.40\times10^5$ in styrene equivalence as determined by GPC. The polymerization degree (p) of the charge-transporting polyester determined from the molecular weight of the monomer was about 200.

EXAMPLE 13

A solution of 10 parts of a zirconium compound (Orgatics ZC540, available from Matsumoto Chemical Industry Co., Ltd.) and 1 part of a silane compound (A110, available from Nippon Unicar Co., Ltd.) in a mixture of 40 parts of isopropanol and 20 parts of butanol was applied to an aluminum pipe by a dip coating method. The coated material was then heated and dried at a temperature of 150° C. for 10 minutes to form an undercoating layer having a thickness of 0.1 μm. Subsequently, 1 part of an X-type metal-free phthalocyanine crystal was mixed with 1 part of a polyvinyl butyral resin (S-Lec BM-S, available from Sekisui Chemical Co., Ltd.) and 100 parts of cyclohexanone. The mixture was then subjected to dispersion with glass beads by means of a sand mill for 1 hour. The resulting coating solution was then applied to the above described undercoating layer by a dip coating method. The coated material was then heated and dried at a temperature of 100° C. for 10 minutes to form a charge-generating layer having a thickness of 0.15 μm. Subsequently, 3 parts of exemplified Compound (6) (Mw: $4.2\times10^4$) as a charge-transporting polyester were dissolved in a mixture of 15 parts of monochlorobenzene and 15 parts of tetrahydrofuran. The resulting coating solution was then applied to the above described charge-generating layer by a dip coating method. The coated material was then heated and dried at a temperature of 115° C. for 1 hour to form a charge-transporting layer having a thickness of 20 μm.

On the other hand, an electrically-conductive roll having a diameter of 12 mm was prepared with using a stainless steel rod having a diameter of 6 mm as a core material, an electrically-conductive EPDM rubber having a resistivity of $10^6$ Ω·cm as an elastic layer and an epichlorohydrin rubber having a resistivity of $10^9$ Ω·cm as a resistive layer.

The photoreceptor and electrically-conductive roll thus obtained were then mounted on a laser beam printer (modified version of XP-11, available from Fuji Xerox Co., Ltd.). With applying a d.c. voltage of 50 V having an a.c. voltage of 1,500 V (peak-to-peak value) superposed thereon to the electrically-conductive roll, an image was sampled. The quality of the image was then evaluated. Thereafter, this printing procedure was repeated 50,000 times. An image was then sampled again. The quality of the image was then evaluated. The abrasion loss of the outermost layer was also measured. The results are shown in Table 28 below.

The same photoreceptor as prepared above was mounted on a laser printer employing an ordinary scorotron charging process (XP-11, available from Fuji Xerox Co., Ltd.). The same evaluation procedures as above was followed. The results are shown in Table 29 below.

EXAMPLE 14

A photoreceptor was prepared in the same manner as in Example 13, except that exemplified Compound (34) (Mw: $1.23\times10^5$) was used as a charge transporting polyester in place of exemplified Compound (6) used in Example 13.

This photoreceptor thus prepared was evaluated in the same manner as in Example 13.

EXAMPLE 15

A photoreceptor was prepared in the same manner as in Example 13, except that exemplified Compound (39) (Mw: $1.2\times10^5$) was used as a charge transporting polyester in place of exemplified Compound (6) used in Example 13.

This photoreceptor thus prepared was evaluated in the same manner as in Example 13.

EXAMPLE 16

A photoreceptor was prepared in the same manner as in Example 13, except that exemplified Compound (40) (Mw: $1.1\times10^5$) was used as a charge transporting polyester in place of exemplified Compound (6) used in Example 13.

This photoreceptor thus prepared was evaluated in the same manner as in Example 13.

EXAMPLE 17

A photoreceptor was prepared in the same manner as in Example 13, except that exemplified Compound (73) (Mw: $1.2\times10^5$) was used as a charge transporting polyester in place of exemplified Compound (6) used in Example 13.

This photoreceptor thus prepared was evaluated in the same manner as in Example 13.

EXAMPLE 18

A photoreceptor was prepared in the same manner as in Example 13, except that a mixture of 2 parts of exemplified Compound (3) (Mw: $1.1\times10^5$) and 1 part of a polycarbonate resin composed of a repeating structural unit represented by the above described structural formula (C) (viscosity-average molecular weight: $Mv=5.0\times10^4$) was used as a charge transporting polyester in place of exemplified Compound (6) used in Example 13.

This photoreceptor thus prepared was evaluated in the same manner as in Example 13.

EXAMPLE 19

A photoreceptor was prepared in the same manner as in Example 13, except that a mixture of 2 parts of exemplified Compound (41) (Mw: $1.3\times10^5$) and 1 part of a polycarbonate resin composed of a repeating structural unit represented by the above described structural formula (C) (viscosity-average molecular weight: $Mv=4.0\times10^4$) was used as a charge transporting polyester in place of exemplified Compound (6) used in Example 13.

This photoreceptor thus prepared was evaluated in the same manner as in Example 13.

COMPARATIVE EXAMPLE 2

A photoreceptor was prepared except that the coating solution for a charge transporting layer was replaced with a coating solution prepared by dissolving 2 parts of a benzidine compound represented by the following formula and 3 parts of a polycarbonate resin having a repeating structural unit represented by the above described structural formula (A) (viscosity-average molecular weight: $Mv=4.0\times10^4$) in a mixture of 10 parts of monochlorobenzene and 10 parts of tetrahydrofuran.

This photoreceptor thus prepared was evaluated in the same manner as in Example 13.

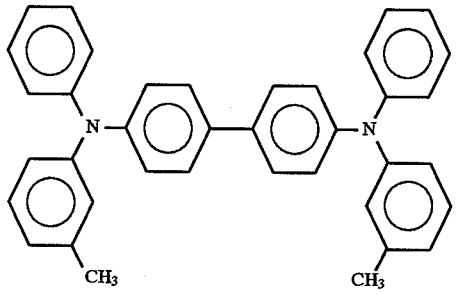

EXAMPLE 20

The procedure of comparative Example 2 was followed to prepare a photoreceptor except that a surface protective layer was formed on the charge transporting layer of comparative Example 2.

The coating solution for the surface protective layer was obtained by dissolving 2 parts of exemplified Compound (73) as a charge-transporting polyester in a mixture of 15 parts of monochlorobenzene and 15 parts of tetrahydrofuran, and this coating solution was applied to the charge-transporting layer by a dip coating method, and then heated and dried at a temperature of 115° C. for 1 hour to form a surface protective layer having a thickness of 5 μm.

This photoreceptor thus prepared was evaluated in the same manner as in Example 13.

EXAMPLE 21

A photoreceptor was prepared in the same manner as in Example 20, except that a mixture of 2 parts of exemplified Compound (1) (Mw: $1.1\times10^5$) and 1 part of a polycarbonate resin composed of a repeating structural unit represented by the above described structural formula (B) (viscosity-average molecular weight: $Mv=4.5\times10^4$) was used as a charge transporting polyester in place of exemplified Compound (73) used in Example 20.

This photoreceptor thus prepared was evaluated in the same manner as in Example 13.

COMPARATIVE EXAMPLE 3

A photoreceptor was prepared in the same manner as in comparative Example 2, except that 3 parts of a hydrazone compound represented by the following formula and 3 parts of a polycarbonate resin composed of a repeating structural unit represented by the above described structural formula (B) (viscosity-average molecular weight: $Mv=5.0\times10^4$) used as a charge transporting material in place of the benzidine compound used in comparative Example 2.

This photoreceptor thus prepared was evaluated in the same manner as in Example 13.

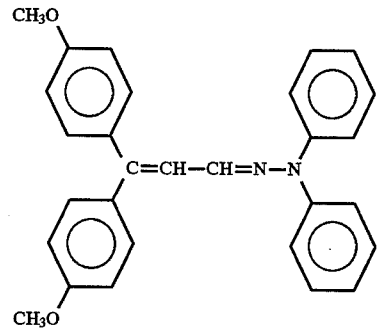

EXAMPLE 22

The procedure of comparative Example 3 was followed to prepare a photoreceptor except that a protective layer composed of a mixture of 2 parts of exemplified Compound No. (1) (Mw: $1.1\times10^5$) and 1 part of a polycarbonate resin having a repeating structural unit represented by the above described structural formula (B) (viscosity-average molecular weight: $Mv=4.5\times10^4$) was formed on the charge-transporting layer of comparative Example 3.

This photoreceptor thus prepared was evaluated in the same manner as in Example 13.

TABLE 28

| Example No. | Image quality after 50,000 sheets of printing | Abrasion loss after 50,000 sheets of printing |
|---|---|---|
| Example 13 | No defects | 2.0 μm |
| Example 14 | No defects | 3.2 μm |
| Example 15 | No defects | 2.2 μm |
| Example 16 | No defects | 1.9 μm |
| Example 17 | No defects | 2.3 μm |
| Example 18 | No defects | 2.4 μm |
| Example 19 | No defects | 2.6 μm |
| Comparative Example 2 | Toner filming occurred after 20,000 sheets of printing; abrasive scratch occurred after 25,000 sheets of printing | 8.7 μm |
| Example 20 | No defects | 2.2 μm |
| Example 21 | No defects | 2.0 μm |
| Comparative Example 3 | Toner filming occurred after 20,000 sheets of printing; abrasive scratch occurred after 25,000 sheets of printing | 9.7 μm |
| Example 22 | No defects | 2.4 μm |

TABLE 29

| Example No. | Image quality after 50,000 sheets of printing | Abrasion loss after 50,000 sheets of printing |
|---|---|---|
| Example 13 | No defects | 1.8 μm |
| Example 14 | No defects | 2.6 μm |
| Example 15 | No defects | 1.9 μm |
| Example 16 | No defects | 1.7 μm |
| Example 17 | No defects | 2.0 μm |
| Example 18 | No defects | 1.9 μm |
| Example 19 | No defects | 2.2 μm |
| Comparative Example 2 | Toner filming occurred after 30,000 sheets of printing | 4.1 μm |
| Example 20 | No defects | 2.0 μm |
| Example 21 | No defects | 1.7 μm |

TABLE 29-continued

| Example No. | Image quality after 50,000 sheets of printing | Abrasion loss after 50,000 sheets of printing |
|---|---|---|
| Comparative Example 3 | Toner filming occurred after 40,000 sheets of printing | 4.6 μm |
| Example 22 | No defects | 2.1 μm |

As mentioned above, the image forming apparatus of the present invention comprises a photoreceptor containing a photosensitive layer comprising the above described charge-transporting polyester and a charging apparatus employing a contact-charging process. As compared with an image forming apparatus comprising a photosensitive layer comprising a conventional charge-transporting material molecularly dispersed in a binder resin, the image forming apparatus of the present invention is less apt to image defects due to abrasion of photosensitive layer and adhesion of foreign substances to photosensitive layer. Thus, the life of the photoreceptor can be remarkably prolonged.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a layer containing a charge-transporting polyester comprising a repeating unit comprising at least one of partial structural units represented by the following formulae (I-a) and (I-b):

(I-a)

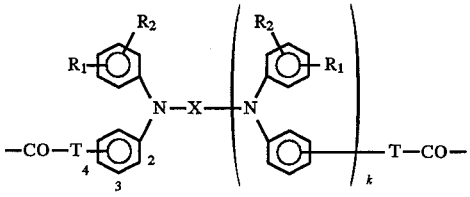

(I-b)

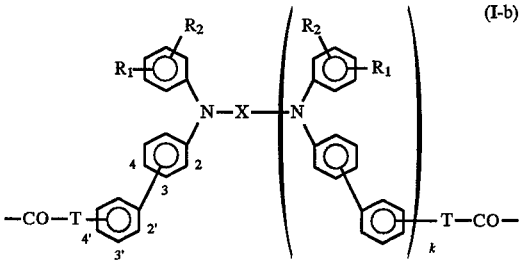

wherein $R_1$ and $R_2$ each independently represent a hydrogen atom, an alkyl group, an alkoxy group, a substituted amino group, a halogen atom or a substituted or unsubstituted aryl group; X represents a substituted or unsubstituted divalent aromatic group; T represents a branched divalent hydrocarbon group containing a $C_{2-10}$ aliphatic moiety; and k represents an integer of 0 or 1.

2. The electrophotographic photoreceptor according to claim 1, wherein:

(1) said charge-transporting polyester comprises at least one of repeating structural units represented by the following formulae (I-a) and (I-b) as a divalent carboxylic acid component and a repeating structural unit represented by the following formula (III) as a divalent alcohol component, is terminated by the following formula (IV-a) or (IV-b) at both ends thereof, and has a polymerization degree of from 5 to 5,000; or (2) said charge-transporting polyester comprises at least one of repeating structural units represented by the following formulae (I-a) and (I-b) and a repeating structural unit represented by the following formula (II) as a divalent carboxylic acid component and a repeating structural unit represented by the following formula (III) as a divalent alcohol component, is terminated by the following formula (IV-a) or (IV-b) at both ends thereof, and has a polymerization degree of from 5 to 5,000:

(I-a)

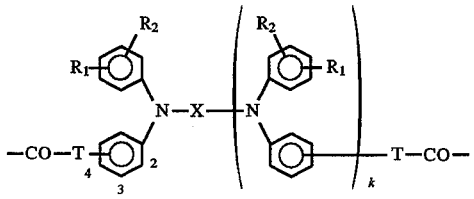

(I-b)

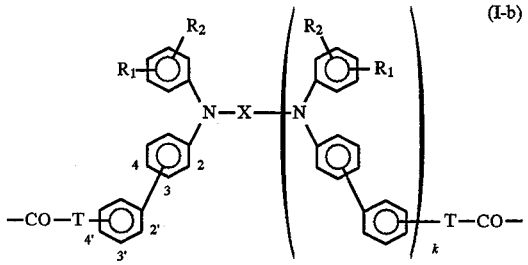

$$-OC-Z-CO- \quad \text{(II)}$$

$$-O-(Y-O)_m- \quad \text{(III)}$$

$$-O-(Y-O)_m-R \quad \text{(IV-a)}$$

$$-O-(Y-O)_m-CO-Z-CO-OR' \quad \text{(IV-b)}$$

wherein $R_1$ and $R_2$ each independently represent a hydrogen atom, an alkyl group, an alkoxy group, a substituted amino group, a halogen atom or a substituted or unsubstituted aryl group; X represents a substituted or unsubstituted divalent aromatic group; T represents a branched divalent hydrocarbon group containing a $C_{2-10}$ aliphatic moiety; Z represents a divalent carboxylic residue; R and R' each represent a hydrogen atom, an alkyl group, a substituted or unsubstituted aryl group or a substituted or unsubstituted aralkyl group; Y represents a divalent alcohol residue; k represents an integer of 0 or 1; and m represents an integer of 1 to 5.

3. The electrophotographic photoreceptor according to claim 1, wherein X in formula (I-a) and (I-b) is a substituted or unsubstituted biphenylene group.

4. The electrophotographic photoreceptor according to claim 2, wherein X in formula (I-a) and (I-b) is a substituted or unsubstituted biphenylene group.

5. The electrophotographic photoreceptor according to claim 1, wherein said layer comprising a charge-transporting polyester further comprises at least one substantially electrically-insulating polymer which is compatible with said charge-transporting polyester.

6. The electrophotographic photoreceptor according to claim 1, wherein said electrophotographic photoreceptor has a photosensitive layer, and said charge-transporting polyester is present in the surface layer of said electrophotographic photoreceptor.

7. The electrophotographic photoreceptor according to claim 2, wherein said electrophotographic photoreceptor has a photosensitive layer, and said charge-transporting polyester is present in the surface layer of said electrophotographic photoreceptor.

8. The electrophotographic photoreceptor according to claim 3, wherein said electrophotographic photoreceptor has a photosensitive layer, and said charge-transporting polyester is present in the surface layer of said electrophotographic photoreceptor.

9. The electrophotographic photoreceptor according to claim 4, wherein said electrophotographic photoreceptor has a photosensitive layer, and said charge-transporting polyester is present in the surface layer of said electrophotographic photoreceptor.

10. The electrophotographic photoreceptor according to claim 6, wherein said photosensitive layer comprises a charge-transporting material comprising said at least one charge-transporting polyester, and a charge-generating material comprising at least one selected from the group consisting of halogenated gallium phthalocyanine crystal, halogenated tin phthalocyanine crystal, hydroxy gallium phthalocyanine crystal and titanyl phthalocyanine crystal.

11. An image forming apparatus comprising a photoreceptor, a charging apparatus, an exposing apparatus and a developing apparatus which operates to form on said photoreceptor an electrostatic image which is then developed to form a visible image, wherein said photoreceptor comprising an electrically-conductive support having thereon a photosensitive layer comprising at least one charge-transporting polyester having a repeating unit comprising at least one of partial structural units represented by the following formulae (I-1) and (I-2), and said charging apparatus is a contact-charging apparatus comprises an electrically-conductive member which comes into contact with the surface of said photoreceptor and to which member a voltage is applied:

(I-1)

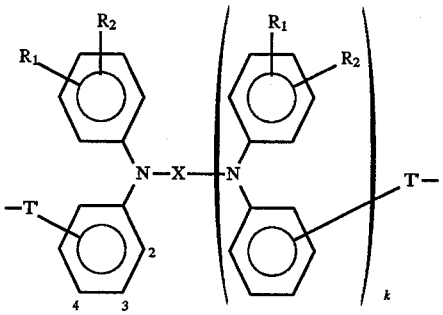

-continued (I-2)

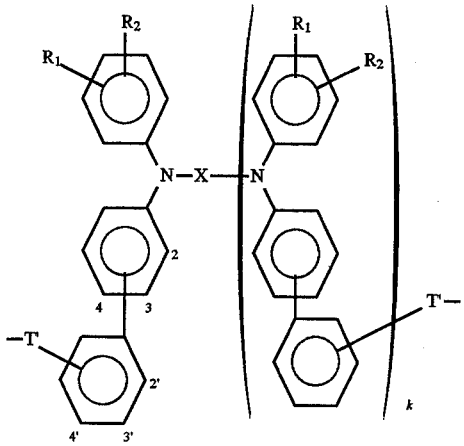

wherein $R_1$ and $R_2$ each independently represent a hydrogen atom, an alkyl group, an alkoxy group, a substituted amino group, a halogen atom or a substituted or unsubstituted aryl group; X represents a substituted or unsubstituted divalent aromatic group; T' represents a $C_{1-6}$ divalent straight-chain hydrocarbon group or a $C_{2-10}$ divalent branched hydrocarbon group; and k represents an integer of 0 or 1.

12. The image forming apparatus according to claim 11, wherein said photosensitive layer comprises a charge-transporting polyester represented by the following formula (II) or (III):

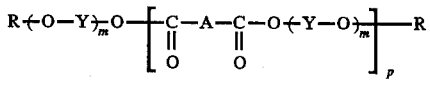

(II)

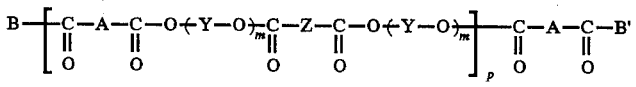

(III)

wherein A represents a structure represented by the above described formula (I-1) or (I-2); R represents a hydrogen atom, an alkyl group, a substituted or unsubstituted aryl group or a substituted or unsubstituted aralkyl group; B and B' each independently represents —O—(Y—O)$_m$—R or —O—(Y—O)$_m$—CO—Z—CO—O—R' (wherein R is as defined above, R' represents a hydrogen atom, an alkyl group, a substituted or unsubstituted aryl group or a substituted or unsubstituted aralkyl group, and m represents an integer of from 1 to 5); Y represents a divalent alcohol residue; Z represents a divalent carboxylic acid residue; m represents an integer of from 1 to 5; and p represents an integer of from 5 to 5,000.

13. The image forming apparatus according to claim 11, wherein said photosensitive layer further comprises a polycarbonate resin having at least one repeating structural unit selected from the group consisting of those represented by the following formulae (A) to (E):

(A)

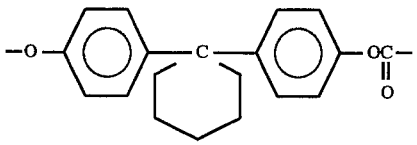

(B)

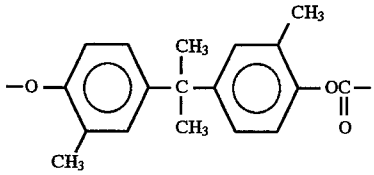

(C)

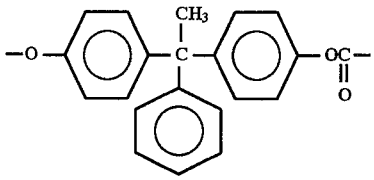

-continued (D)

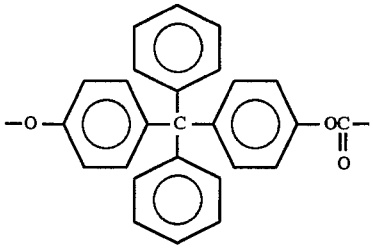

(E)

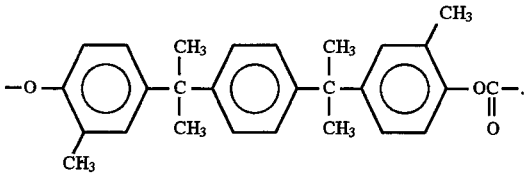

14. The image forming apparatus according to claim 11, wherein said photosensitive layer comprises a plurality of layers and the layer containing said charge-transporting polyester is the outermost layer of said photosensitive layer.

15. The image forming apparatus according to claim 12, wherein said photosensitive layer comprises a plurality of layers and the layer containing said charge-transporting polyester is the outermost layer of said photosensitive layer.

16. The image forming apparatus according to claim 13, wherein said photosensitive layer comprises a plurality of layers and the layer containing said charge-transporting polyester is the outermost layer of said photosensitive layer.

* * * * *

UNITED STATES PATENT AND TRADEMARK OFFICE

CERTIFICATE OF CORRECTION

PATENT NO. : 5,654,119

DATED : August 5, 1997

INVENTOR(S) : Toru ISHII, Fumio OJIMA, Kiyokazu MASHIMO, Tomozumi UESAKA, Tomoo KOBAYASHI, Katsumi NUKADA, Akira IMAI and Masahiro IWASAKI It is certified that error appears in the above-indentified patent and that said Letters Patent is hereby corrected as shown below:

On the front cover, in item [75], change "Minami-ashigara, Japan" to --Minami Ashigara--Japan--.

Signed and Sealed this

Thirtieth Day of December, 1997

*Attest:*

*Attesting Officer*

BRUCE LEHMAN

*Commissioner of Patents and Trademarks*